US007587896B2

(12) United States Patent
Bin-Nun et al.

(10) Patent No.: US 7,587,896 B2
(45) **Date of Patent: *Sep. 15, 2009**

(54) COOLED INFRARED SENSOR ASSEMBLY WITH COMPACT CONFIGURATION

(75) Inventors: Uri Bin-Nun, Chelmsford, MA (US); Jose P. Sanchez, Lawrence, MA (US); Usha Virk, Wellesley, MA (US); Xiaoyan Lei, Boxborough, MA (US)

(73) Assignee: FLIR Systems, Inc., Wilsonville, OR (US)

( * ) Notice: Subject to any disclaimer, the term of this patent is extended or adjusted under 35 U.S.C. 154(b) by 462 days.

This patent is subject to a terminal disclaimer.

(21) Appl. No.: 11/433,697

(22) Filed: May 12, 2006

(65) Prior Publication Data

US 2007/0261407 A1 Nov. 15, 2007

(51) Int. Cl.
*F01B 29/10* (2006.01)

(52) U.S. Cl. ..... 60/517; 62/6

(58) Field of Classification Search ..... 60/517–526; 62/6

See application file for complete search history.

(56) References Cited

U.S. PATENT DOCUMENTS

| | | | | |
|---|---|---|---|---|
| 3,742,719 | A | 7/1973 | Lagodmos | |
| 4,024,727 | A | 5/1977 | Berry et al. | |
| 4,231,418 | A | 11/1980 | Lagodmos | |
| 4,291,547 | A * | 9/1981 | Leo | 62/402 |
| 4,475,346 | A | 10/1984 | Young et al. | |
| 4,505,119 | A | 3/1985 | Pundak | |
| 4,514,987 | A | 5/1985 | Pundak et al. | |
| 4,550,571 | A | 11/1985 | Bertsch | |
| 4,574,591 | A | 3/1986 | Bertsch | |
| 4,588,026 | A | 5/1986 | Hapgood | |
| 4,619,112 | A * | 10/1986 | Colgate | 62/6 |
| 4,711,650 | A | 12/1987 | Faria et al. | |
| 4,846,861 | A | 7/1989 | Berry et al. | |
| 4,858,442 | A | 8/1989 | Stetson | |

(Continued)

FOREIGN PATENT DOCUMENTS

| | | |
|---|---|---|
| EP | 0 778 452 | 12/1996 |
| FR | 2 733 306 | 4/1995 |
| FR | 2 741 940 | 12/1995 |

*Primary Examiner*—Hoang M Nguyen
(74) *Attorney, Agent, or Firm*—The H.T. Than Law Group

(57) ABSTRACT

An integrated sensor assembly (10) includes a gas compression unit (104) having a first longitudinal axis (308) and a gas expansion unit (112) having a second longitudinal axis (366) and the gas expansion unit is disposed with its second longitudinal axis orthogonal to the gas compression unit first longitudinal axis (308). A rotary motor (302) includes a rotor (324) supported for rotation with respect to a motor rotation axis (328) and the sensor assembly configuration is folded to orient the motor rotation axis substantially parallel with the second longitudinal axis (366). A motor shaft (320) extending from the rotor includes a first and second mounting features (336, 340) disposed substantially parallel with and radially offset from the motor rotation axis (328). A first drive coupling couples between the first mounting feature (336) and a gas compression piston (304) and drives the piston (304) with a reciprocal linear translation directed along the first longitudinal axis (308). A second drive coupling couples between the second mounting feature (340) and a gas displacing piston (362) and drives the piston (362) with a reciprocal linear translation directed along said second longitudinal axis (366).

21 Claims, 10 Drawing Sheets

U.S. PATENT DOCUMENTS 4,967,558 A 11/1990 Emigh et al.
5,076,058 A 12/1991 Emigh et al.
5,195,320 A * 3/1993 Kushnir ..... 60/517
5,197,295 A 3/1993 Pundak
5,317,874 A * 6/1994 Penswick et al. ..... 60/517
5,596,875 A 1/1997 Berry et al.
5,638,684 A 6/1997 Siegel et al.
5,647,217 A 7/1997 Penswick et al.
5,735,128 A 4/1998 Zhang et al.
5,775,109 A 7/1998 Eacobacci, Jr. et al.
5,822,994 A 10/1998 Belk et al.
5,895,033 A 4/1999 Ross et al.
6,050,092 A 4/2000 Genstler et al.
6,065,295 A 5/2000 Hafner et al.
6,070,414 A 6/2000 Ross et al.
6,094,912 A 8/2000 Williford
6,144,031 A 11/2000 Herring et al.
6,167,707 B1 1/2001 Price et al.
6,256,997 B1 7/2001 Longsworth
6,327,862 B1 12/2001 Hanes
6,397,605 B1 6/2002 Pundak
6,532,748 B1 3/2003 Yuan et al.
6,595,006 B2 7/2003 Thiesen et al.
6,595,007 B2 7/2003 Amano
6,701,721 B1 3/2004 Berchowitz
6,778,349 B2 8/2004 Ricotti et al.
6,779,349 B2 8/2004 Yoshimura
6,809,486 B2 10/2004 Qiu et al.
6,886,348 B2 5/2005 Ogura
6,915,642 B2 7/2005 Ravex
2007/0261417 A1 * 11/2007 Bin-Nun ..... 62/6

* cited by examiner

COOLED INFRARED SENSOR ASSEMBLY WITH COMPACT CONFIGURATION

CROSS REFERENCE TO RELATED APPLICATIONS

The present invention is related to co-pending and ca-assigned U.S. patent applications:

Ser. No. 11/433,376, entitled MINIATURIZED GAS REFRIGERATION DEVICE WITH TWO OR MORE THERMAL REGENERATOR SECTIONS, by Un Bin-Nun filed even dated herewith;

Ser. No. 11/433,689, entitled FOLDED CRYOCOOLER DESIGN, by Bin-Nun et al. filed even dated herewith;

Ser. No. 11/432,957, entitled CABLE DRIVE MECHANISM FOR SELF TUNING REFRIGERATION GAS EXPANDER, by Un Bin-Nun filed even dated herewith; the entirety of each of which is incorporated herein by reference.

BACKGROUND OF THE INVENTION

1. Field of the Invention

The invention provides an integrated miniature infrared sensor assembly cooled by a cryocooler and configured with a reduced assembly volume capable of being enclosed within a more compact spherical volume envelop. In particular, the infrared sensor assembly utilizes a folded cryocooler design configured with a gas compression unit and a gas expansion unit attached to a crankcase and configured with a single rotary motor coupled by first drive linkages to a gas compression piston and by second drive linkages to a gas displacing piston for moving each piston with a reciprocating linear motion. The arrangement of the first and second drive linkages provides a particularly compact cryocooler configuration.

2. Description of Related Art

Miniature cryogenic refrigeration devices, hereinafter cryocoolers, are utilized for various cooling applications e.g. for cooling infrared sensors and other electronic elements. Cryocoolers are employed in airborne tracking and reconnaissance cameras, in industrial handheld and fixed camera installations and in scientific instruments. In many applications, it is desirable to minimize the size, weight and power consumption of the cryocooler.

Conventional cryocoolers based on a gas refrigeration cycle are known and commercially available. Such cryocoolers include a gas compression unit and a gas volume expansion unit interconnected by a fluid conduit. The known devices may be integrated as a unitary element or split, with the gas compression unit and the gas volume expansion unit being separated. In a conventional refrigeration cycle, e.g. a Stirling refrigeration cycle, refrigeration gas is processed in stages to generate cooling power. The refrigeration gas or fluid is first compressed by the gas compression unit, then pre cooled by exchanging thermal energy with a thermal regenerator module, expanded by the gas volume expansion unit and then preheated by a second exchange of thermal energy with the thermal regenerator module. The gas expansion process generates cooling power and the cooling power is used to draw thermal energy away from an element to be cooled.

Generally the gas compression unit includes a compression cylinder and a compression piston movable within the compression cylinder to compress the refrigeration gas during each compression stroke of the piston. Similarly, the gas volume expansion unit includes a gas volume expansion cylinder and a gas displacing piston movable within the gas volume expansion cylinder. Movement of the displacing piston cyclically expands and contracts the volume of an expansion space formed at a cold end of the gas volume expansion cylinder. Each of the gas compression piston and gas displacing piston reciprocates along a linear path defined by its associated cylinder. The gas compression piston moves in a compression stroke cycle and generates peak pressure pulses during the compression stage of the refrigeration cycle. The gas displacing piston moves in an expansion stroke cycle to expand the volume of the gas expansion space during the expansion stage of the refrigeration cycle.

Integrated cryocoolers are available that utilize a single rotary motor mechanically coupled to both the gas compression piston and the gas expansion piston using first and second drive couplings. In addition, the first and second drive couplings are configured to appropriately synchronize the movement of the gas compression piston and the gas displacing piston to thereby cause the compression stroke and the expansion stoke to occur at the required stage of the refrigeration cycle. Specific examples of commercially available integrated cryocooler configurations include the FLIR Systems Inc. models MC-3 and MC-5, manufactured in Billerica Mass., and the Ricor Corporation models K560 and K548 manufactured in Israel. Other examples of integrated cryocoolers configurations are disclosed in U.S. Pat. No. 3,742,719 by Lagodmos entitled CRYOGENIC REFRIGERATOR, published on Jul. 3, 1973, and in U.S. Pat. No. 4,858,442 by Stetson entitled MINIATURE INTEGRAL STIRLING CRYOCOOLER, published on Aug. 22, 1989 and commonly assigned with the present application.

Generally there is a need in the art to further miniaturize cooled infrared sensor assemblies to fit the sensor assemblies within smaller volume enclosures. The present invention provides an improved cooled infrared sensor assembly configured with a folded cryocooler layout for reducing the volume of the device. The folded cryocooler layout includes more compact drive couplings as described below. Moreover, the improved drive couplings provide a novel configuration with separate attaching features for driving the gas compression piston and the gas displacing piston independently.

BRIEF SUMMARY OF THE INVENTION

The present invention overcomes the problems cited in the prior by providing an integrated sensor assembly (10) that includes a gas compression unit (104) formed with a first longitudinal axis (308) and a gas expansion unit (112) formed with a second longitudinal axis (366). The gas expansion unit is disposed with its second longitudinal axis (366) orthogonal to the gas compression unit first longitudinal axis (308).

A rotary motor (302) includes a rotor (324) supported for rotation with respect to a motor rotation axis (328) and the sensor assembly configuration is folded to orient the motor rotation axis (328) substantially parallel with the second longitudinal axis (366). A motor shaft (320) extends from the rotor (302) and includes a first mounting feature (336), formed with a third longitudinal axis (334), and a second mounting feature (340), formed with a fourth longitudinal axis (342). Each of the third and fourth longitudinal axes are disposed substantially parallel with and radially offset from the motor rotation axis (328).

A first drive coupling couples between the first mounting feature (336) and a gas compression piston (304) and drives the gas compression piston (304) with a reciprocal linear translation directed along the first longitudinal axis (308). A second drive coupling couples between the second mounting feature (340) and a gas displacing piston (362) and drives the gas displacing piston (362) with a reciprocal linear translation directed along the second longitudinal axis (366).

A radiation sensor array (12) configured to produce an analog electrical signal responsive to infrared radiation, in a wavelength range of 3-5 microns, falling thereon, is attached to a cold end of the gas expansion unit (112) and a Dewar assembly (16) attached to the gas expansion unit (112) at the cold end is formed to enclose the radiation sensor array (12) within a sealed evacuated chamber (18). The integrated sensor assembly (10) may also include a digital signal processor (30) for receiving the analog electrical signal from the sensor array (12) and converting the analog electrical signal to a digital image signal. In addition, the sensor assembly may be configured with electrical pass through connections (28) connected to the sensor array (12) and passing through the Dewar assembly (16) to the digital processor (30) to communicate the analog electrical signal generated by the sensor array to the digital signal processor (30).

A unitary crankcase (306) is formed with exterior walls surrounding hollow interior cavities and is configured to house the first and second drive couplings in the internal cavities. The crankcase (306) supports the gas compression unit (104) along the first longitudinal axis (308) and the gas expansion unit (112) along the second longitudinal axis (366). The crankcase further supports the rotary motor (304) with the motor rotation axis (328) disposed substantially parallel with the second longitudinal axis (366).

The integrated radiation sensor assembly may be configured with two different second drive couplings. A first embodiment of the second drive coupling is formed by a plurality of interconnected mechanical linkages connected between the motor shaft second mounting feature (340) and the gas displacing piston (362). The linkages apply a continuous driving force to the gas displacing piston (362) to thereby continuously control the instantaneous position of the gas displacing piston throughout each revolution of the motor rotor (324).

A second embodiment of the second drive coupling is formed by a tensioning element (606), or cable, connected between the motor shaft second mounting feature (340) and the gas displacing piston (362). The tensioning element applies a discontinuous tensioning drive force to the gas displacing piston (362). The discontinuous tensioning drive force is only applied during part of each revolution of the motor rotor (324). The tensioning force pulls the gas displacing piston from its stroke top end position (85) to its stroke bottom end position (83). A compression spring (622) installed between the gas displacing piston (362) and a cable base (616) provides a biasing force for forcing the gas displacing piston toward its top end position (85).

BRIEF DESCRIPTION OF THE DRAWINGS

The features of the present invention will best be understood from a detailed description of the invention and a preferred embodiment thereof selected for the purposes of illustration and shown in the accompanying drawing in which.

DETAILED DESCRIPTION OF THE INVENTION

Radiation Sensor Assembly

Figure 1:
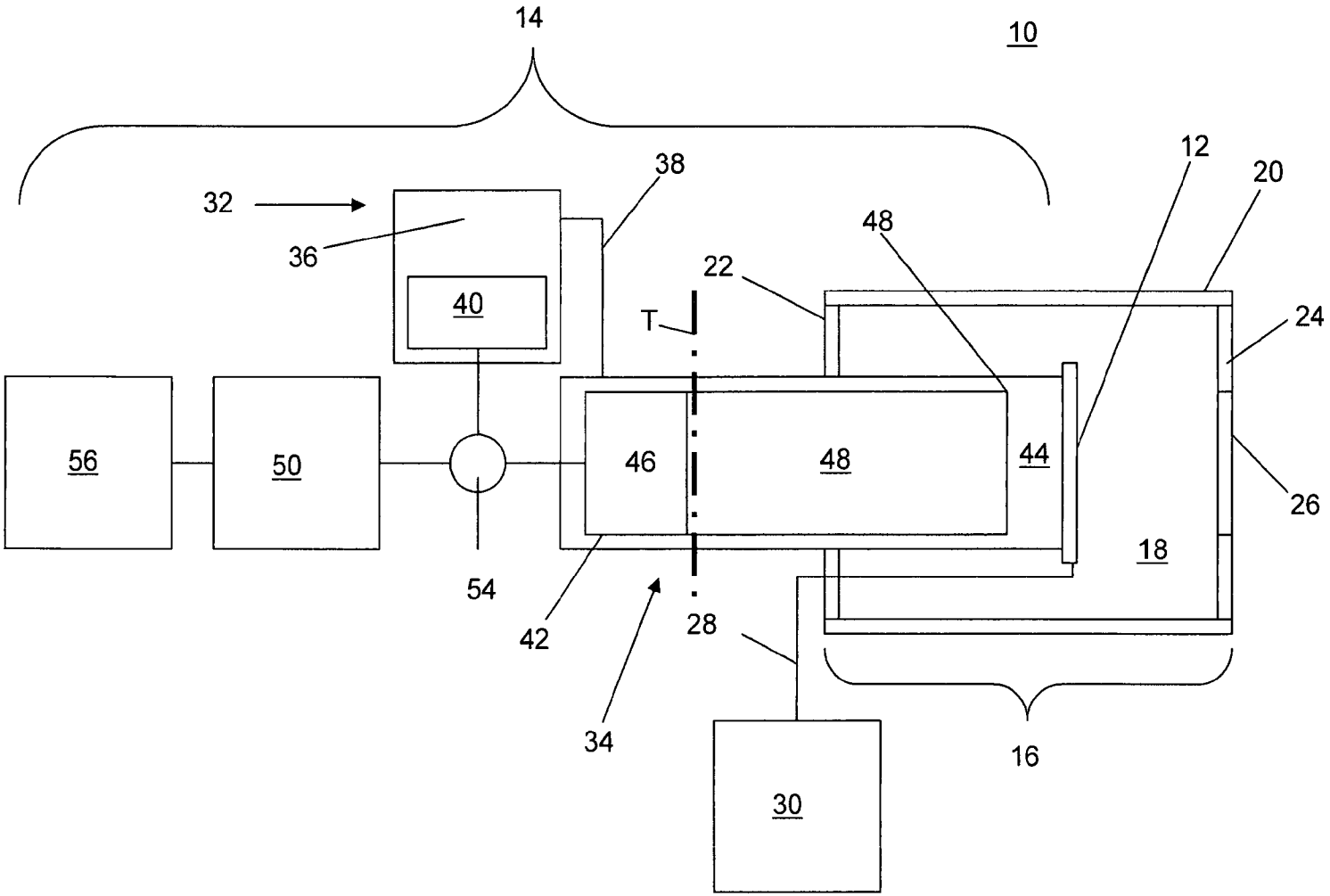
FIG. 1 illustrates a schematic representation of a radiation detector assembly configured with an integrated cryocooler having a single rotary motor drive.

Referring to FIG. 1, an integrated radiation sensor assembly 10 is shown schematically. The sensor assembly 10 includes a radiation sensor array 12 of the type that is typically operated at a cryogenic temperature, e.g. below 150 degrees Kelvin (° K.). The radiation sensor array 12 is supported in contact with or otherwise in thermal communication with a miniature refrigeration device or cryocooler, generally indicated by reference numeral 14. The sensor array 12 is housed inside a Dewar assembly 16 which encloses the sensor within a sealed evacuated chamber 18. The chamber 18 is enclosed by a surrounding annular side wall 20, a base wall 22, and a top wall 24. The base wall 22 is configured for attaching the Dewar 18 to the cryocooler 14, and the top wall 24 includes a radiation transparent window 26 passing therethrough such that infrared radiation received from scene to be recorded enters the chamber 18 through the window 26. The transparent window 26 may also serve as a field of view aperture for limiting the cone angle of radiation reaching the sensor array 12. The Dewar 18 functions to thermally isolate the radiation sensor array 12 from the surrounding air at ambient temperature. In particular, the evacuated chamber 18 resists irradiant thermal energy exchange with the surrounding air.

In operation, radiation from a scene to be recorded enters the transparent window 26 and falls onto the radiation sensor array 12. The scene radiation excites the sensor array 12 and generates an analog electrical signal therein. The sensor array 12 and Dewar 16 are configured with electrical pass through connections 28 for communicating the analog electrical signal generated by the sensor array to a digital signal processor 30, which generates a digital image of the scene. A typical cooled sensor array 12 may comprise many thousands of sensor picture elements or pixels comprising an Indium Antimony (InSb) substrate having an optimized electrical signal response to infrared radiation in a wavelength range of 3-5 microns.

The cryocooler 14 comprises a working volume filled with a refrigeration gas and the working volume includes the collective volume of a gas compression unit 32, a gas volume expansion unit 34, and an interconnecting fluid conduit 38. The cryocooler 14 is configured to operate in accordance with the Stirling refrigeration cycle which generates refrigeration cooling by cyclically expanding and compressing the volume and pressure of the working fluid contained therein. Generally, the gas compression unit 32 includes a movable compression piston 40, supported within a compression cylinder. The compression cylinder includes a compression volume 36 which cyclically expands and contracts in accordance with cyclic movement of the compression piston 40. The cyclic movement of the compression piston 40 also generates a cyclic pressure pulse in the refrigeration fluid contained within the working volume.

The gas volume expansion unit 34 includes a movable gas displacing piston 42 supported within an expansion cylinder. The expansion cylinder includes a gas expansion space 44 which cyclically expands and contracts in accordance with cyclic movement of the gas displacing piston 42 with respect to the expansion cylinder. The cyclic movement of the gas displacing piston 42 is used to generate refrigeration cooling in the gas expansion space 44 and to thereby cool the sensor assembly 12. The gas displacing piston 42 further includes a fluid control module 46 for controlling the bi-directional flow of refrigeration fluid into and out of the gas volume expansion unit 34 and for sealing an open end of the expansion cylinder. A regenerator module 48 is disposed between the flow control module 46 and the expansion space 44 and is configured as a fluid passage for guiding the bi-directionally flow of refrigeration gas along its longitudinal length. The refrigeration fluid exchanges thermal energy with the regenerator module 48 on each pass along its length. Cold refrigeration fluid flowing out of the expansion space 44 towards the fluid control module 46 is pre-heated by the regenerator module 48. Warm refrigeration fluid flowing out of the gas compression unit 32 towards the expansion space 44 is pre-cooled by the regenerator module 48 as it flows along its length.

The cryocooler 14 also includes a motor element 50 and a first and second drive coupling 54 with the first drive coupling being disposed between the motor element 50 and the compression piston 40 and the second drive coupling being disposed between the motor and the gas displacing piston 42. The motor element 50 is electrically controlled by a motor driver 56 which delivers a driving current to the motor 50.

In the example sensor assembly 10 the cryocooler 14 is designed to cool the radiation sensor array 12 from an ambient temperature, e.g. 270-330° K., to a cold or operating temperature, e.g. 50-100° K. and to maintain the sensor at the cold temperature during operation of the device. The length of time that it that takes to cool the sensor from the ambient temperature to the cold temperature is called the "cool down" time, which in conventional cryocooler devices may range from 2 to 20 minutes depending on the ambient temperature, the thermal cooling load presented by the Dewar and the sensor array, the electrical power available and other factors. In other applications the integrated cryocooler of the present invention may be used to cool other devices to cryogenic temperatures. In addition, other gas refrigeration cycles are usable without deviating from the present invention.

Stirling Refrigeration Cycle

Figure 2:
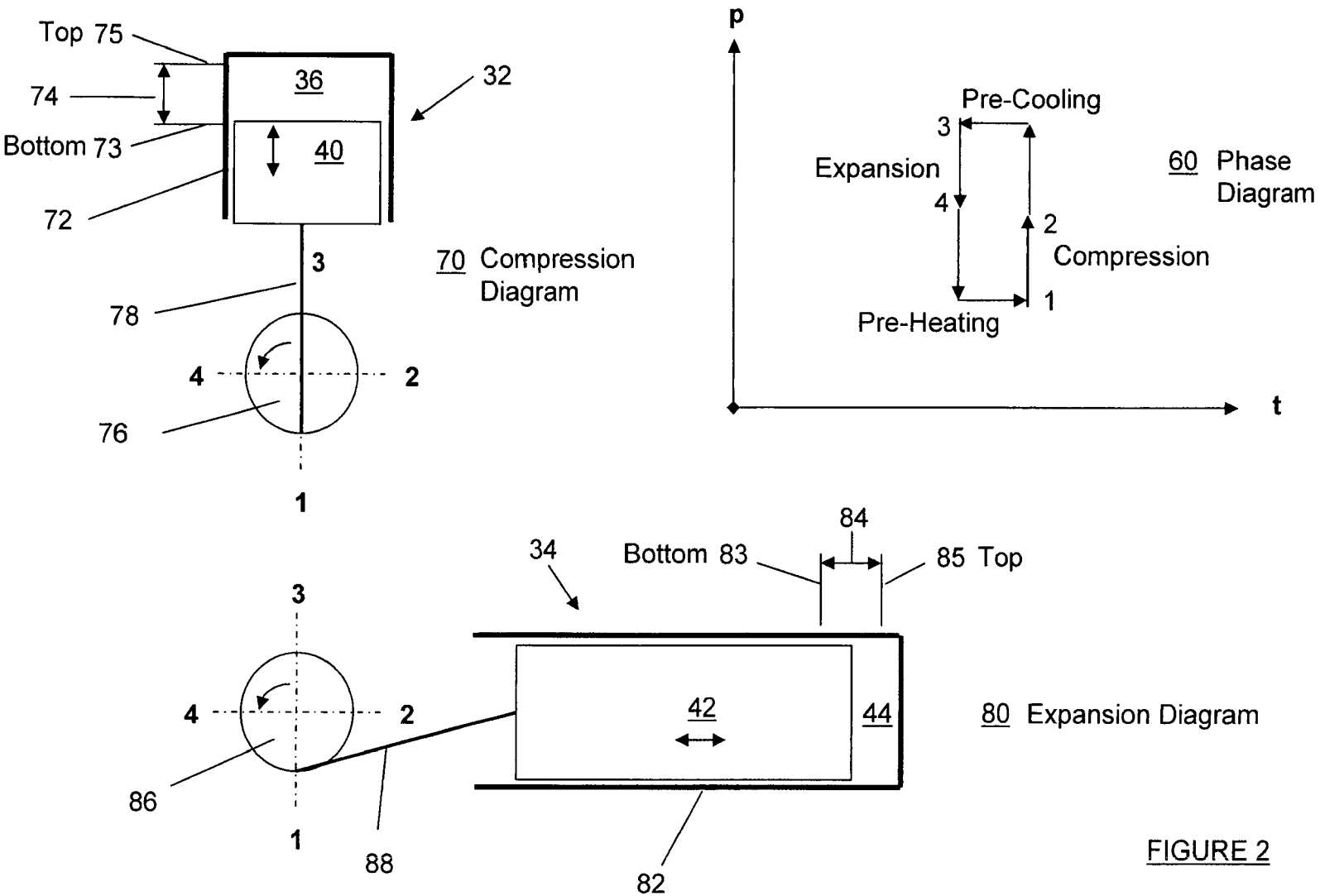
FIG. 2 illustrates a process diagram, a compression diagram and an expansion diagram for illustrating the process steps of a refrigeration cycle.

A preferred embodiment of the present invention operates in accordance with a Stirling refrigeration cycle. The Stirling refrigeration cycle utilizes four process steps to generate cooling and the four process steps, when continuously repeated, deliver a steady state cooling power at the device cold end. FIG. 2 includes a phase diagram 60 which plots refrigeration gas pressure vs temperature during each step of the ideal Stirling refrigeration fluid cycle. Those skilled in the art will recognize that the fluid phase diagram 60 is a theoretical phase diagram used here merely to illustrate the process steps. Starting at the fluid pressure/temperature coordinates 1 the first "compression" step is an isothermal increase in the fluid pressure shown as the transition from point 1 to point 2. The second "pre-cooling" step is an isobaric decrease in the fluid temperature, shown as the transition from point 2 to point 3. The third "expansion" step is an isothermal decrease in the fluid pressure, shown as the transition from point 3 to point 4. The fourth "pre-heating" step is an isobaric increase in the fluid temperature, shown as the transition form point 4 to point 1. A compression diagram 70, and an expansion diagram 80 illustrate the respective movement of the gas expansion piston and the gas displacing piston for each of the cycle steps 1-4.

Referring to the diagram 70, the gas compression unit 32 is shown with the gas compression piston 40 is movable within a compression cylinder 72 and the movement of the compression piston 40 varies the volume of the gas compression volume 36. A first drive coupling is represented schematically by a circular disk 76 rotating about a center axis, and a drive link 78 connected between the circular disk 76 and the gas compression piston 40. The linear movement of the piston 40 has a stroke range 74 corresponding with 180° of the disk 76. The compression piston starts the cycle at a bottom end position 73 when the drive link 78 is at the position 1. The compression piston 40 moves to a top end position 75 when the disk 76 is rotated 180° thereby placing the end of the drive link 78 at position 3. In the diagram 70, the disk 76 rotates counterclockwise around the central axis to generate a reciprocating linear motion of the compression piston 40 which cyclically moves between the bottom end position 73 and the top end position 75.

Referring to the diagram 80, the gas expansion unit 34 is shown with the gas displacing piston 42 movable within an expansion cylinder 34 and the movement of the displacing piston 42 varies the volume of a gas expansion space 44. A second drive coupling is represented schematically by a circular disk 86 rotating about a center axis, and a drive link 88 connected between the circular disk 86 and the gas displacing piston 42. The linear movement of the piston 42 has a stroke range 84 corresponding with 180° of rotation of the disk 86. The displacing piston starts the cycle at a mid-stroke position when the drive link 88 is at the position 1. The displacing piston 42 moves to a top end position 85 when the motor shaft 86 is rotated 90° thereby placing the end of the drive link 88 at position 2. In the diagram 80, the disk 86 rotates counterclockwise around the central axis to generate a reciprocating linear motion of the compression piston 42 which cyclically moves between the bottom end position 83 and the top end position 85. As illustrated above, for an ideal Stirling refrigeration cycle the movement of the gas displacing piston 42 lags the movement of the gas compression piston 40 by 90° of rotation of the circular disk 76. In further embodiments of the invention, detailed below, the movement of the gas displacing piston may lag by other phase angles, e.g. in the approximate range of 70°-110°.

Gas Compression Unit and the First Drive Coupling

Figure 3:
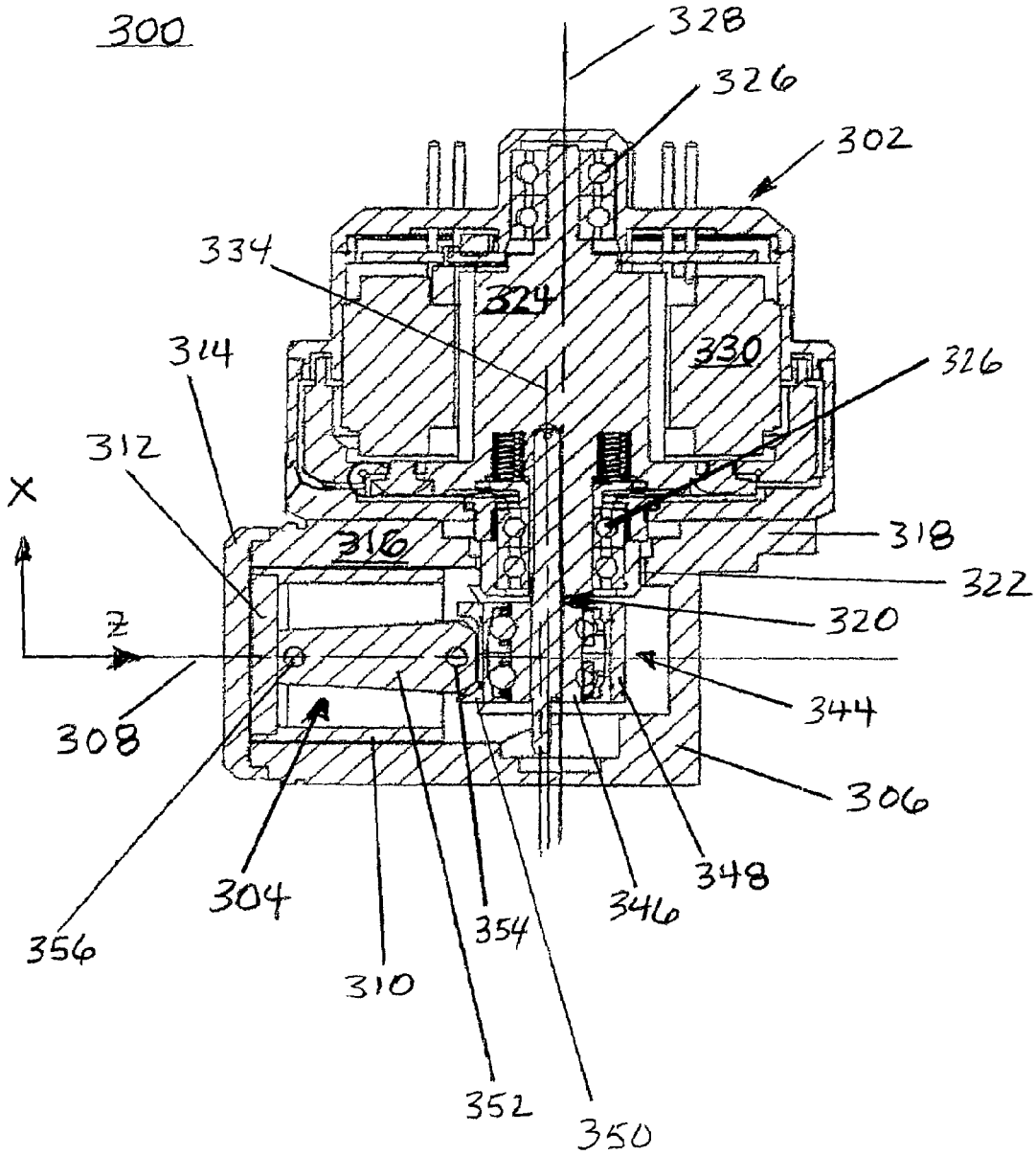
FIG. 3 illustrates a section view taken through a first drive coupling and rotary DC motor according to the present invention.
Figure 4:
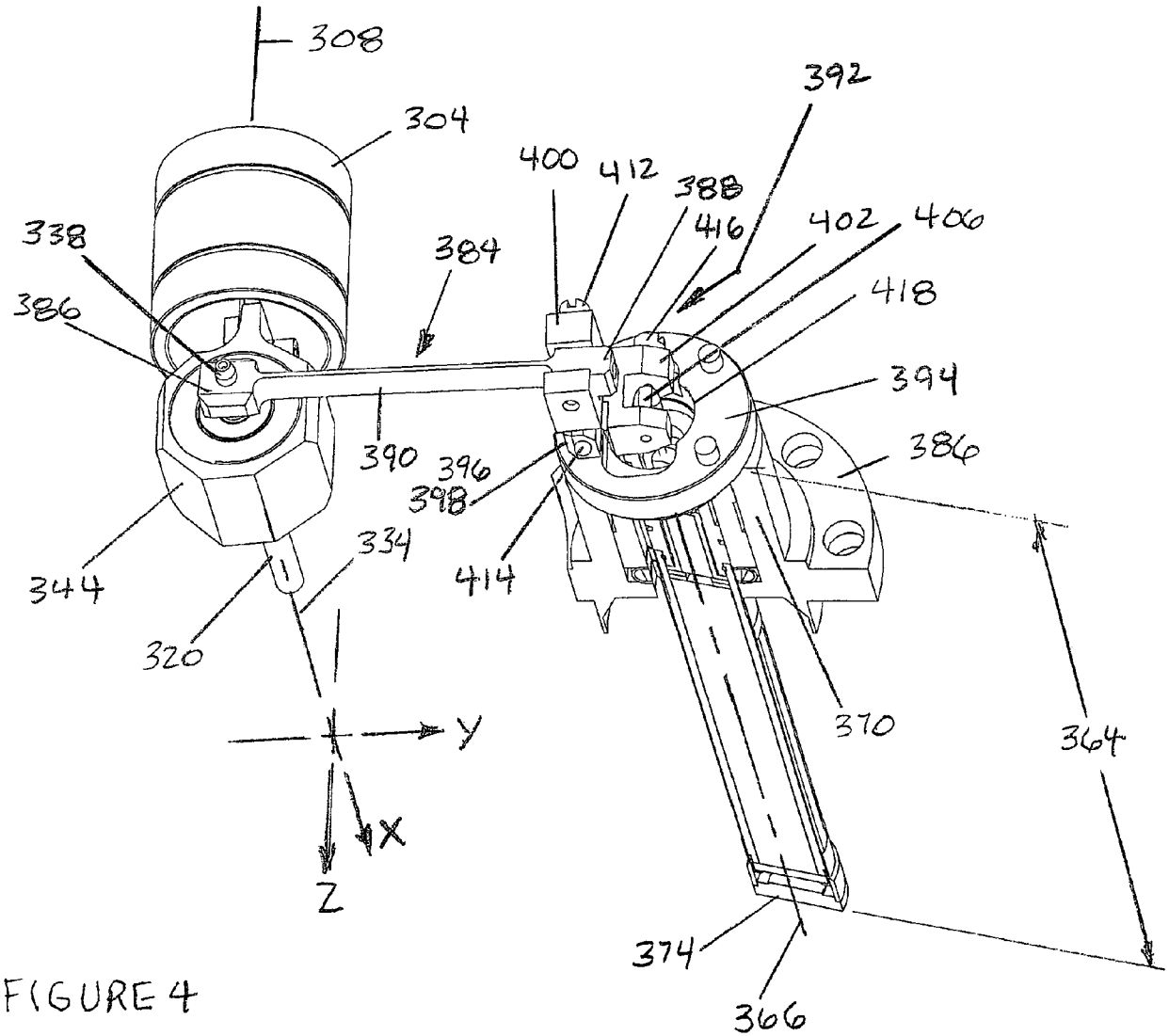
FIG. 4 illustrates a first isometric internal view of an integrated cryocooler configured with a second drive coupling of interconnecting mechanical linkages according to the present invention.
Figure 5:
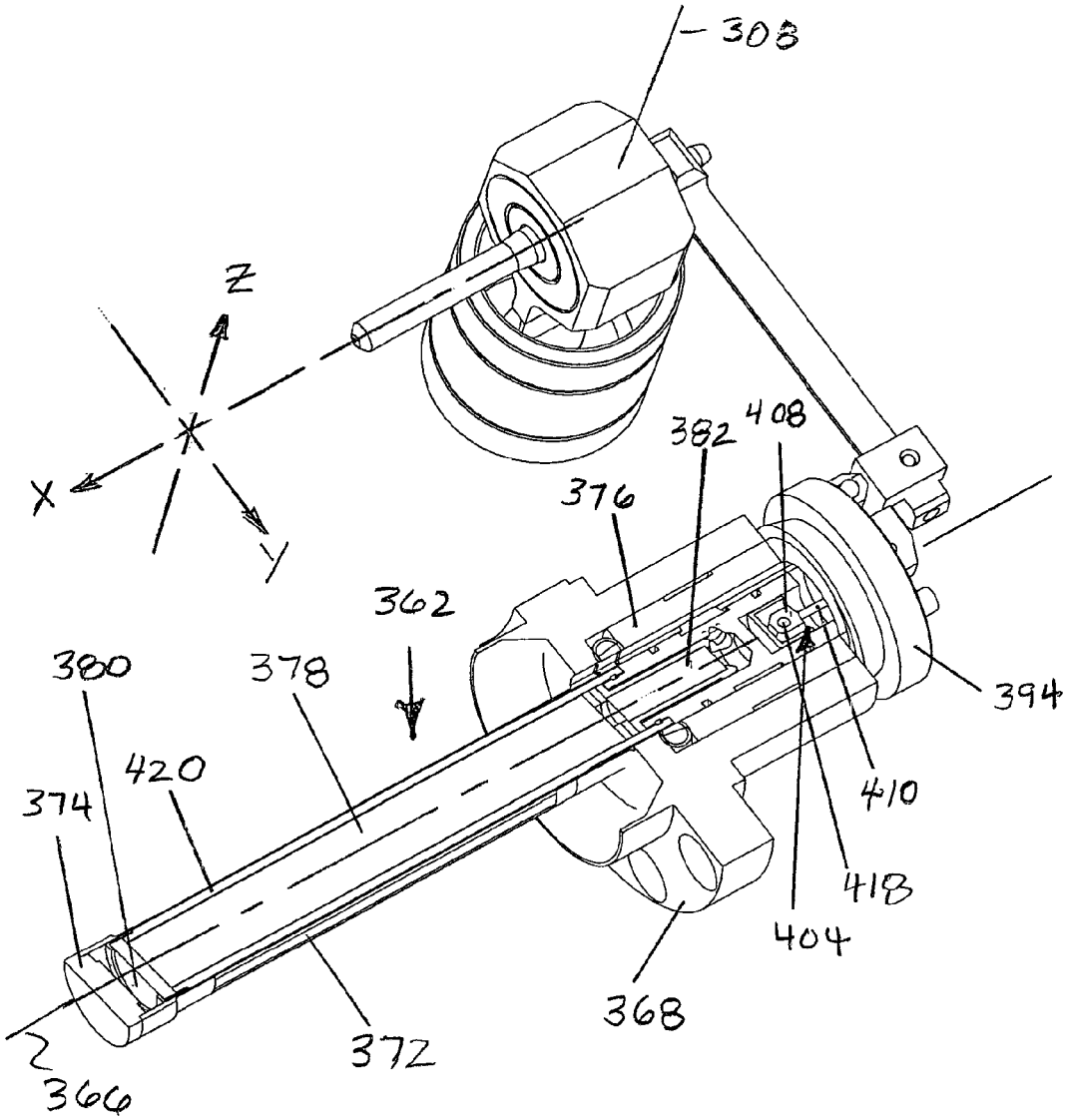
FIG. 5 illustrates a second isometric internal view of an integrated cryocooler configured with the second drive coupling of interconnecting mechanical linkages according to the present invention.

FIG. 3 is a section view through a gas compression unit, a rotary motor and a first drive coupling module coupled between the gas compression unit and the rotary motor in a system X-Z plane. As shown, a DC motor 302 includes a motor shaft 320 extending therefrom and coupled with a gas compression piston, generally identified by the reference numeral 304, by a first drive coupling. The gas compression piston 304 is movably supported within a gas compression cylinder formed in the body of a crankcase 306. The compression cylinder has a first longitudinal axis 308, which defines an arbitrary system Z coordinate axis. As shown in FIGS. 4 and 5, a gas expansion unit includes a gas expansion cylinder 364 with a second longitudinal axis 366 that is disposed parallel with the system X coordinate axis.

The gas compression piston 304 comprises an annular piston outer wall 310 and a circular cross-sectioned piston head 312, attached thereto. An outside diameter of the annular piston outer wall 310 and an inside diameter of the compression cylinder are form fitted to provide a gas clearance seal. The gas clearance seal prevents pressurized refrigeration gas from escaping from the compression cylinder, while still allowing movement of the gas compression piston 304 along the first longitudinal axis 308. The radial clearance of the gas clearance seal may be in the range of 0.001-0.0015 mm, (50-100 micro inches), or less, if it can be achieved by a practical process.

The gas compression cylinder is sealed at a high pressure end thereof by a head cover 314 attached to the crankcase 306. A cylindrical compression volume (36 in FIG. 1), is formed between the head cover 314 and the piston head 312 and movement of the gas compression piston 304 varies the volume of the compression volume to generate cyclic pressure pulses within the refrigeration gas contained within the working volume of the refrigeration device. A fluid conduit, (38 in FIG. 1), is in fluid communication with the compression volume 36 and allows refrigeration gas to flow bi-directionally in and out of the compression volume 36 in response to variation in its volume.

The crankcase 306 comprises a metal casting, e.g. steel or aluminum, and includes a solid annular surrounding wall 316 formed to house the gas compression cylinder and a motor supporting wall 318 for receiving the DC motor 302 mounted thereon. A drive end of the DC motor 302 includes the motor shaft 320 extending therefrom. The drive end and motor shaft install into the crankcase 306 through an aperture 322 in the supporting wall 318.

The DC motor 302 includes a rotor 324 supported by opposing rotary bearings 326 for rotation about a motor rotation axis 328. The DC motor 302 further includes a stator or armature assembly 330 configured with conductive windings formed therein. The rotor 324 includes permanent magnets supported thereon and the rotor 324 and stator 330 interact to generate an electromotive force for rotating the rotor at a substantially constant rotational velocity in response to an electrical drive current delivered to the stator conductive windings. One example of a preferred embodiment of the DC motor 302 is disclosed in co-pending and commonly assigned U.S. patent application Ser. No. 10/830,630, by Bin Nun et al., filed on Apr. 23, 2004, entitled REFRIGERATION DEVICE WITH IMPROVED DC MOTOR, the entire content of which is incorporated herein by reference.

Figure 7:
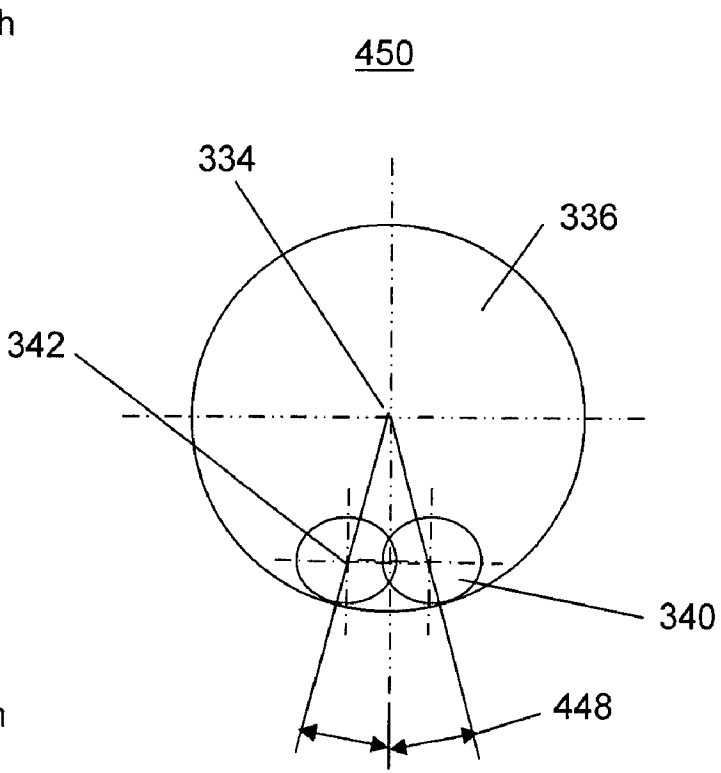
FIG. 7 illustrates alternate embodiments of the DC motor shaft with a second mounting feature shown offset by a phase angle suitable for advancing or retarding the start of the expansion process step.
Figure 6:
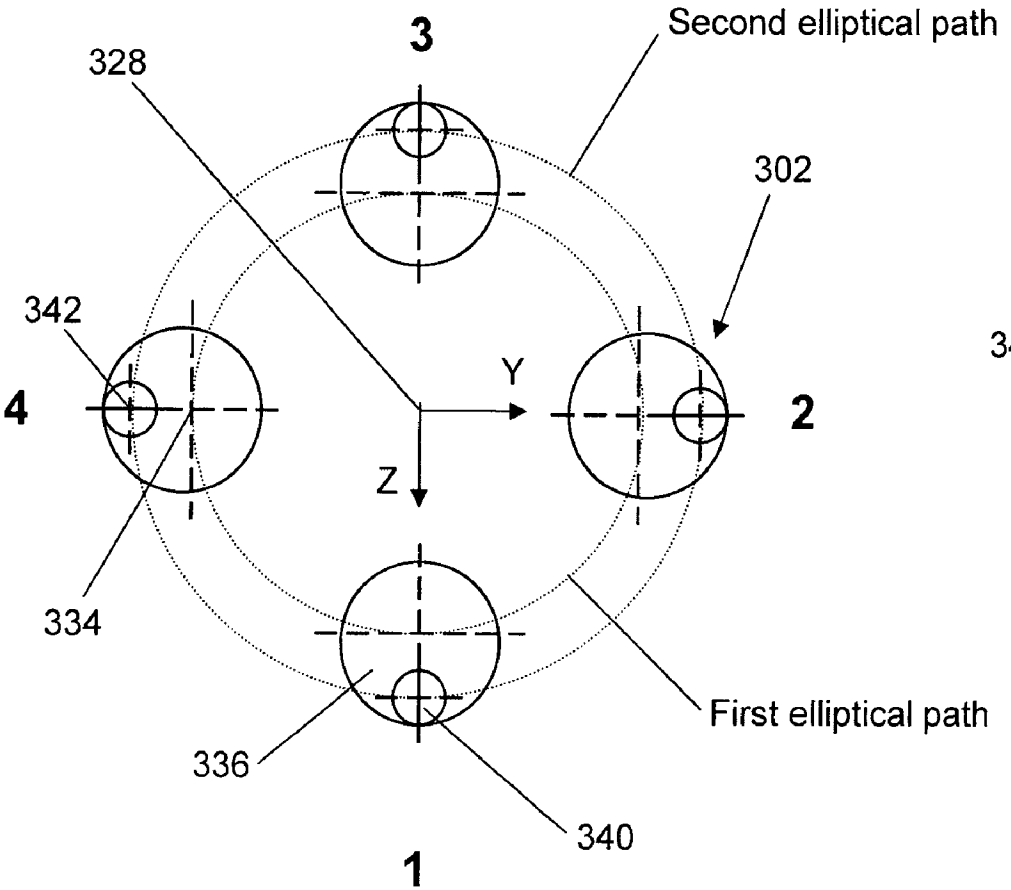
FIG. 6 illustrates the position and orientation of a DC motor shaft with respect to a motor rotation axis of the DC motor for each of the process steps 1-4.
Figure 8:
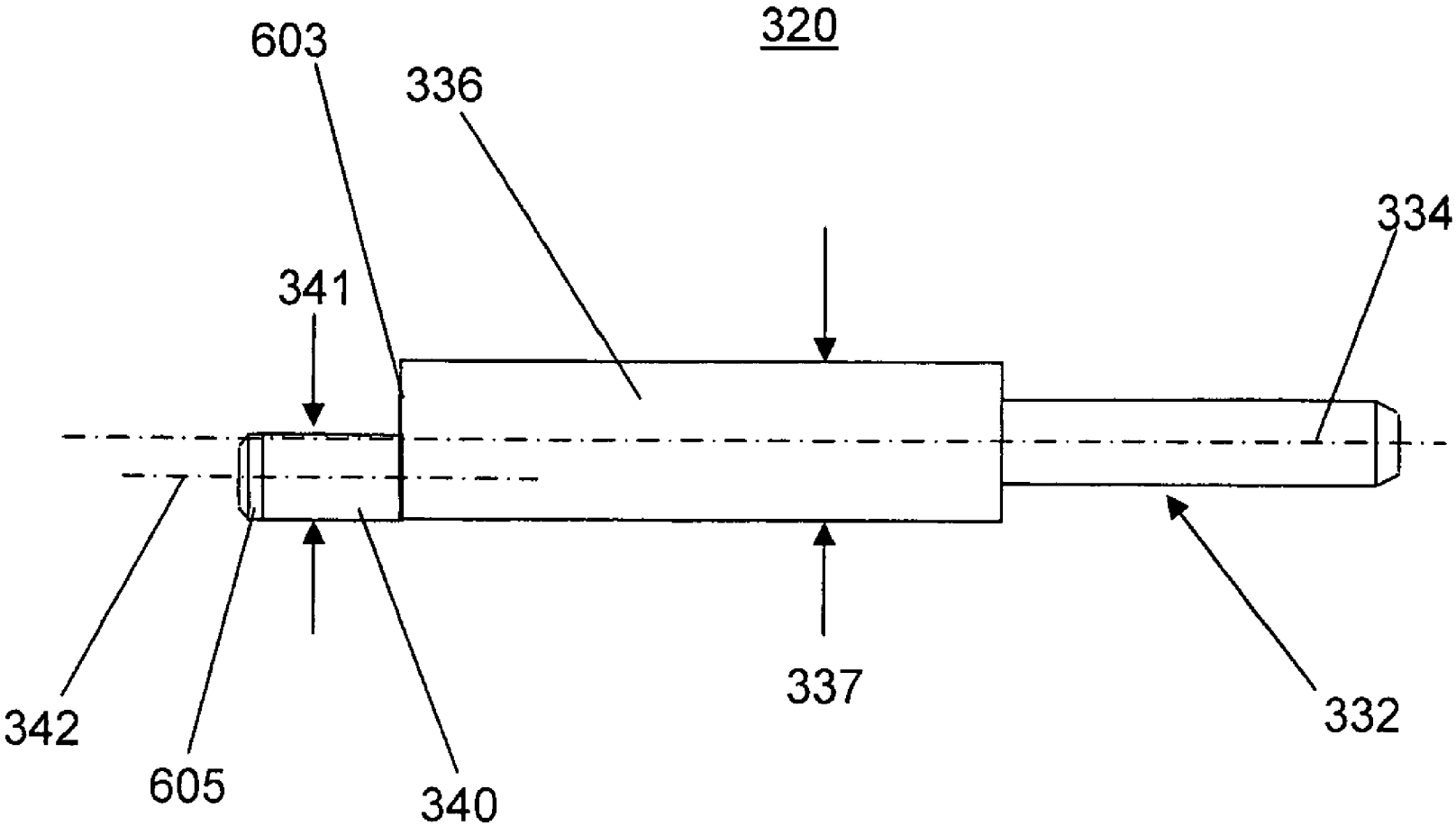
FIG. 8 illustrates a side view of a motor shaft according to the present invention.

The motor shaft 320 is fixedly attached to a motor rotor 324 and the shaft 320 is radially offset from the motor rotation axis 328 so it rotates eccentrically or circularly about the motor rotation axis 328. The motor shaft 320 is depicted in FIGS. 6-8. The motor shaft 320 includes a motor mounting feature 332 for fixedly securing the motor shaft 320 to the rotor 324. In the example motor shaft embodiment shown in FIG. 8 the mounting feature 332 is a cylindrical diameter having a longitudinal axis 334.

The motor shaft further includes a first mounting feature 336 used to interface with the first drive coupling module. In the example motor shaft of FIG. 8, the first mounting feature comprises a cylindrical diameter 337 having a third longitudinal axis 334. In the example embodiment, first mounting feature 336 and the motor mounting feature 332 have the same third longitudinal axis 334, however in other embodiments; the motor mounting feature 332 may have a different longitudinal axis offset from the third longitudinal axis 334. In either case, the motor shaft 320 attaches to the motor rotor 324 with its third longitudinal axis 334 radially offset from the motor rotation axis 328 so that rotation of the motor rotor 324 causes the third longitudinal axis 334 to traverse a first eccentric path around the motor rotation axis 328 as the rotor rotates. The first eccentric path may be circular or elliptical. The first mounting feature 336 interfaces with the first drive coupling to drive the gas compression piston 304 with a reciprocal linear motion.

The motor shaft 320 further includes a second mounting feature 340 extending longitudinally from the first mounting feature 336 and formed with a second diameter 341 and a fourth longitudinal axis 342. The fourth longitudinal axis 342 is disposed radially offset from the motor rotation axis 328 and is also radially offset from the third longitudinal axis 334 so that rotation of the motor rotor 324 causes the fourth rotation axis 328 to traverse a second eccentric path around the motor rotation axis 328 as the rotor rotates. The second eccentric path may be circular or elliptical. The second mounting feature 340 interfaces with a second drive coupling to drive gas displacing piston 362 with a reciprocal linear motion.

The first drive coupling module comprises a duplex bearing set 344 rotatably attached to the first mounting feature 336. The bearing set 344 includes paired inner races 346 fixedly attached, e.g. by a press fit, onto the first mounting feature 336. The bearing set 344 also includes paired outer races 348, supported for rotation with respect to the paired inner races 346. The paired outer races 348 are configured with an attaching element 350 for attaching the outer races 348 to a flexible vane drive link 352. The flexible vane drive link 352 includes an input end configured to attach to the attaching element 350 and an output end configured to attach to the gas compression piston at the piston head 312. The attaching element 350 is fixedly attached to the paired outer races 348 and may include a pin used to align and transfer driving forces from the attaching element to the link input end. The attaching element 350 may also include a clamp, not shown, for securing the input end of the drive link 352 thereto. The duplex bearing set 344 minimizes mechanical play between the paired inner and outer races to reduce noise and vibration, to stiffen the first drive coupling, and to reduce bearing wear. However, a single rotary bearing or a bushing is also usable without deviating from the present invention.

The flexible vane link 352 comprises a bendable leaf spring. The leaf spring has a longitudinal axis that extends from the input end to the output end. The leaf spring comprises a thin layer of spring steel or other suitable flexure material having a thickness dimension orthogonal to its longitudinal length and a width dimension orthogonal to the thickness dimension and to the longitudinal length. The thickness dimension is selected to allow repeated bending of the link without permanent deformation. In the example shown in FIG. 3, the thickness dimension is orthogonal to the X and Z axes, the width extends along the X-axis and the longitudinal length extends along the Z-axis. The leaf spring is bendable in response to forces applied in the Y direction e.g. by Y-axis motion components of a drive force delivered to the input end.

In the example of FIG. 3, the leaf spring is formed with a buckle resistant shape by providing a tapered width, with the input end having a wider width than the output end. This causes bending to start at the output end. Specifically, the width of the input end is approximately 5.8 mm, (0.23 inches), the width of the output end is approximately 4.3 mm, (0.17 inches) and the longitudinal length of the leaf spring is approximately 14.6 mm (0.575 inches). The drive link 352 further includes through holes 354, at the input end, and 356, at the output end, provided to attach the input end to the attaching element 350 and to attach the output end to the piston head 312. Pins installed through the holes 354 and 356 attach the link 352 to the attaching element 350 and to the piston head 312 and serve to align the link 352 and to transfer the driving forces generated by movement of the first mount feature 336 to the link input end and to transfer drive forces generated by movement of the link output end to the gas compression piston head 312. Clamps, not shown, may also be provided to secure the input and output ends of the link 352 to the attaching element 350 and piston head 312 respectively.

During each rotation of the motor rotor 324, the motor shaft traverses an eccentric path around the motor rotation axis 328 causing each of the first and second mounting features to move through a different eccentric path around the motor rotation axis 328. Accordingly, the first mounting feature 336 and its third longitudinal axis 334 traverse a first eccentric path around the motor rotation axis 328 causing the duplex bearing set 344 to move through the first eccentric path and to drive the input end of the flexible vane link 352 over the first eccentric path. The first eccentric path may comprise an elliptical path or a circular path around the motor rotation axis 328. Similarly, the second mounting feature 340 and its fourth longitudinal axis 342 traverse a second eccentric path around the motor rotation axis 328 causing the second mounting feature to drive an input end of a second drive coupling, described below, over the second elliptical path, which may also comprise an elliptical path or a circular path.

In particular, each of the first and second mounting features is moved through a different eccentric path around the motor rotation axis 328 and the motion of each mounting feature includes a component of reciprocating linear translation directed along the Z-axis and along the Y-axis. In the case of the first mounting feature 336 a Z-axis component of reciprocating linear motion is transferred to the gas compression piston 304 along the longitudinal axis of the flexible drive link 352 and drives the gas compression piston 304 through the stroke motion range 74 from the top end 75 to the bottom end 73, as shown in FIG. 2. In FIG. 3, the piston head 312 is shown at the top end position 75. As is best understood from FIG. 6, when the piston head 312 is in the top end position, (position 3 in FIGS. 2 and 6), the third longitudinal axis 334 is opposed to the motor rotation axis 328 in a negative Z direction. When the piston head 312 is in the bottom end position 73, (position 1 in FIGS. 2 and 6), the third longitudinal axis 334 is opposed to the motor rotation axis 328 in the positive Z direction. Accordingly, the piston head 312 is moved from the top end position 75 to the bottom end position 73 by 180° of motor shaft rotation.

The first mounting feature 336 is also driven by a Y-axis component of reciprocating linear motion which is transferred to the input end of the flexible drive link 352 but merely bends the flexible drive along its longitudinal length. As is best viewed in FIG. 6, a maximum amplitude Y-axis component of the first mounting feature occur at positions 2 and 4 or 90° out of phase with the top and bottom end positions of the piston head 312.

Gas Expansion Unit and the Second Drive Coupling

A second drive coupling module attaches at its input end to the motor shaft second mounting feature 340 and transfers Y and Z axis components of reciprocating linear translation received therefrom through a plurality of interconnected mechanical linkages to its output end. The output end is coupled to a gas displacing piston, generally 362, housed within the gas volume expansion unit shown in each of FIGS. 4 and 5. The interconnected mechanical linkages are configured to convert the Y-axis motion of the motor shaft second mounting feature 340 into reciprocating linear translation of the gas displacing piston 362 along the system X-axis, which cyclically varies the volume of a gas expansion space 380 disposed at the cold end of a gas expansion cylinder 364.

As shown in FIGS. 4 and 5 the gas expansion cylinder 364 surrounds the second longitudinal axis 366 and supports the gas displacing piston 362 for reciprocating linear translation along a second longitudinal axis 366. According to the present invention, the second longitudinal axis 366 is disposed substantially orthogonal to the gas compression cylinder first longitudinal axis 308 and is substantially parallel with the DC motor rotation axis 328. Accordingly, the second longitudinal axis 366 is parallel with the system X coordinate axis and mutually perpendicular with each of the system Y and Z coordinate axes. As best viewed in FIG. 5, the gas expansion cylinder 364 is open at a warm end thereof for receiving the gas displacing piston 362 therein, and closed and sealed at a cold end thereof by an end cap 374. The warm end attaches to the crankcase 306 by a flange 368. Preferably, the gas expansion unit cold end is cantilevered away from its warm end and the crankcase 306 to thermally isolate the cold end from the warm end. As shown in the external view of FIG. 10, the crankcase 306 includes a flange 369 configured to receive the gas expansion unit thereon. Preferably the interface between the crankcase flange 369 and the expansion unit flange 368 is configured as a conductive thermal barrier T that resists thermal conduction from the warm end toward the cold end.

The gas expansion cylinder 364 is formed as a pressure vessel comprising a first tube element 370 joined together with a second tube element 372 and an end cap 374. The end cap 374 is joined together with the second tube element 372 to form the closed cold end. The warm end of the pressure vessel is open to receive the gas displacing piston 362 through the open end and the gas displacing piston includes a fluid control module 376 at its warm end for sealing the warm end of the pressure vessel.

The first tube element 370 is formed with a thick annular wall and includes the flange 386 formed integrally therewith. The second tube element 372 is formed with a thin annular wall for reducing thermal conduction along its length. In addition, the joint between the first tube element 370 and the second tube element 372 includes insulating elements and is configured to resist thermal conduction across the joint. This provides the thermal conduction barrier T between the cantilevered cold end and the crankcase. Preferably, each of the first tube 370, second tube 372 and the end cap 374 comprises steel or another metal substrate selected for its formability, high stiffness and welding properties. Ideally the first tube 370, second tube 372 and the end cap 374 are attached together by a laser weld which provides an excellent sealing joint for high pressure applications.

The gas displacing piston 362 comprises a fluid control module 376 disposed at its warm end and a thermal regenerator module 378 that extends from the warm end to a cold end of the gas displacing piston 362. The fluid control module 376 is disposed inside the second tube element 372 and serves to seal the warm end of the pressure vessel and to control the flow of refrigeration fluid into and out of the gas expansion cylinder 364. The interface between the fluid control module 376 and the first tube element 370 is sealed by a gas clearance seal. The gas clearance seal prevents pressurized refrigeration gas from escaping through the expansion cylinder open end, while still allowing linear movement of the gas displacing piston 370 along the second longitudinal axis 366. The radial clearance of the gas clearance seal may be in the range of 0.001-0.0015 mm, (50-100 micro inches), or less, if it can be achieved by a practical process.

The gas displacing piston 362 is formed with a fluid flow passage extending along its longitudinal length. The fluid flow passage extends through the fluid control module 376 and the regenerator module 378 and provides a bidirectional flow path for refrigeration gas to enter the expansion cylinder 364 at the warm end and to flow into and out of a gas expansion space 380 formed at the cold end of the expansion cylinder 364. The longitudinal length of the gas displacing piston 362 substantially fills the expansion cylinder 364 except for a hollow cylindrical volume at the cold end of the gas expansion cylinder defining the gas expansion space 380. Reciprocal movement of the gas displacing piston 362 along the second longitudinal axis 366 causes the volume of the gas expansion space 380 to cyclically expand and contract. As described above, expansion of the volume of the gas expansion space 380 during the expansion cycle generates refrigeration cooling of the refrigeration gas contained therein. Contraction of the volume of the expansion space 380 during the pre-heating cycle expels refrigeration gas from the expansion space 380 and forces the expelled gas to flow through the regenerator module 378 and back toward the gas compression unit.

The thermal regenerator module 378 comprises a porous solid regenerator matrix material surrounded by a thermally insulating tube element 420. The regenerator matrix material is configured to exchange thermal energy with the refrigeration gas as the gas flows along its longitudinal length during each of the pre-cooling and pre-heating phases of the refrigeration cycle. In addition, a second thermal regenerator module 382 may also be disposed inside the fluid control module 376 to provide additional thermal energy storage. One example of a preferred embodiment of a regenerator module usable with the present inventions is disclosed in co-pending and commonly assigned U.S. patent application Ser. No. 10/444,194, by Bin Nun et al., filed on May 23, 2003 and entitled LOW COST HIGH PERFORMANCE LAMINATE MATRIX, the entire content of which is hereby incorporated herein by reference.

The second drive coupling module 360 includes a first link 384 comprising an input coupling 386 at its input end, an output coupling 388 at its output end, and a flexure element 390 disposed between the input coupling and the output coupling. The input coupling 386 fits over the diameter 341 of the motor shaft second mounting feature 340 and is driven along the second eccentric path as the motor rotor 324 is rotated by the DC motor 320. The output end of the first link 384 is pivotally attached to a second link formed as a rocker element 392. Movement of the input end of the first link 384 causes the rocker element 392 to pivot about a pivot axis defined by a pivot pin 414. The rocker element 392 is pivotally attached to a third link 404 that interconnects the rocker element 392 and the gas displacing piston 362. The third link 404 comprises an input coupling 406 at its input end, an output coupling 408 at its output end, and a flexure element 410 disposed between the input and output couplings.

The rocker element 392 is pivotally attached to a rocker base 394 by the pivot pin 414. The rocker base 394 comprises a disk-shaped element that is fixedly attached to the first tube element 370 and includes a clevis element 396 extending therefrom to pivotally support the rocker element 392. The rocker base 394 also includes an aperture 418, passing through its center, for providing access for the third link 404 to pass into the expansion cylinder 364 and attach to the gas displacing piston 362. The clevis element 396 includes opposing spaced apart attaching members that extend upwardly from the rocker base 394 for receiving a corresponding pivot base 398 of the rocker element 392 there between.

The rocker element 392 generally comprises a solid L-shaped element formed with the pivot base 398, for interfacing with the clevis element 396, and with two clevis shaped arms extending orthogonally from the pivot base 398. A first clevis shaped arm 400 is generally disposed parallel with the system X-axis and attaches to the first link output coupling 388. The second clevis shaped arm 402 is generally disposed parallel with the system Y-axis and attaches to the input coupling 406 of the third link 404. Each of the attaching points with the rocker element 392 is a pivoting attaching point formed by installing a pivot pin through opposing clevis elements. A pivot pin 412 is fixedly attached to the first arm 400 and pivotally attaches to the first link output coupling 388. Similarly, a pivot pin 414 is fixedly attached to the clevis element 396 and pivotally attaches to the pivot base 398. A pivot pin 416 is fixedly attached to the second arm 402 and pivotally attached to the third drive link input coupling 406 and a pivot pin 418 id fixedly attached to gas displacing piston 362 and pivotally attached to the third drive link output end 408. In a preferred embodiment, the pivot pins 412, 414, 416 and 418 are externally threaded at one end thereof and mate with internal threads formed in one of the corresponding opposing clevis members to fixedly attach the pins to a clevis member. In addition, the pins are pivotally installed through bores provided in the pivoting elements and the pins and bores are sized to allow pivoting with minimal mechanical play.

The third link 404 links the rocker element second arm 402 to the gas displacing piston 362 and delivers driving forces thereto. The third drive link output coupling 408 is pivotally attached to the gas displacing piston 362. Preferably, the third drive link 404 is formed as a unitary element comprising prehardened stainless steel and having a rectangular cross-section.

Operation of the Second Drive Coupling

As stated above, during each rotation of the motor shaft 320, the second mounting feature 340 and its fourth longitudinal axis 342 traverse the second eccentric path around the motor rotation axis 328 and drive the second drive coupling input coupling 386 along the second eccentric path. The second eccentric path may be divided into two perpendicular components of reciprocating linear translation comprising a first component directed along the Y-axis and a perpendicular second component directed along the Z-axis. The Y-axis component generates a bi-directional driving force directed substantially along the longitudinal axis of the first link 384 that rocks the rocker element 392 in a reciprocating pivoting motion with the pivot pin 414 as its pivot axis. The Z-axis component of reciprocating linear translation merely bends the flexure element 390 along its longitudinal length. The bending starts at an attaching edge between the flexure element 390 with the output coupling 388 and the bend extends along the longitudinal axis of the flexure element.

The rocking of the rocker element 392 about its pivot pin 414 causes the distal end of the second arm 402 to move in an arcuate motion. The arc has orthogonal components of reciprocating linear translation along the X-axis and along the Y-axis. The X-axis component generates a bi-directional driving force substantially along the longitudinal axis of the third link 404 that drives the gas displacing piston 362 with a reciprocating linear translation along the second longitudinal axis 366. In particular, the second drive coupling operates to push the gas displacing piston 362 (in the positive X-direction), from the bottom end of the stroke to the top end of the stroke and to pull the gas displacing piston, (in the positive X-direction), from the top end of the stroke to the bottom end of the stroke. Reciprocal movement over the gas displacing piston 362 over the stroke length cyclically varies the volume of the expansion space 380.

The Y-axis component of reciprocating linear translation delivered to the third link input coupling 406 merely bends the third link flexure element 410 along its longitudinal axis. Thus according to one aspect of the present invention, the second drive coupling converts a rotary motion delivered by moving the fourth longitudinal axis 342 along the second elliptical path to a reciprocating linear translation of the gas displacing piston 362 along the second longitudinal axis 366.

Motor Shaft Rotation Phase Relationships

Referring to FIGS. 2 and 6, the example cryocooler of the present invention utilizes a single rotary motor 302 to reciprocate the gas compression piston 40 and the gas displacing piston 42 between respective top and bottom stroke positions. The relative phase of motion between the gas compression piston 40 and the gas displacing piston 42 is such that the position of the gas displacing piston 42 lags the position of the gas compression piston by 90° of motor shaft rotation.

Diagram 70, shown in FIG. 2, details the reciprocating translation of the gas compression piston 40 through the stroke distance 74 from the bottom end position 73 to the top end position 75 using step positions 1-4. Each step position is separated by 90° of motor shaft rotation. Diagram 80, shown in FIG. 2, details the reciprocating translation of the gas displacing piston 42 through the stroke distance 84 from the bottom end position 83 to the top end position 85 using the same step positions 1-4.

FIG. 6 shows a diagram representing an end view of the DC motor 302 taken in the system Y-Z plane with the motor rotation axis 328 located at the system Y-Z coordinate axes. In particular, the diagram of FIG. 6 displays the orientation and location of the first mounting feature 336 and its third longitudinal axis 334 and the second mounting feature 340 and its fourth longitudinal axis 342 with respect to the motor rotation axis 328 for each of the step positions 1-4. In addition, the diagram of FIG. 6 displays a dashed outline of the first elliptical path taken by the third longitudinal axis 334 and a dashed outline of the second elliptical path taken by the fourth longitudinal axis 342, during each rotation of the motor rotor.

The motor shaft of the example embodiment is shown in side view in FIG. 8 and is configured with the first mounting feature 336 formed with a diameter 337 extending along the third longitudinal axis 334. The motor shaft mounting feature 332 that installs into the motor rotor is coaxial with the third longitudinal axis 334. In this example configuration, the first elliptical path traversed by the third longitudinal axis 334 is a circular path around the motor rotation axis 328. In other embodiments of the motor shaft 320 and or the motor rotor 324 usable with the present invention the third longitudinal axis 334 may be positioned to traverse an elliptical path around the motor rotation axis 328 with a major and a minor ellipse diameter. In any case, the diameter of the first elliptical path along the Z coordinate axis defines the stroke length of the gas compression piston, which may be varied by changing the rotor or the shaft configuration.

As shown in FIGS. 6 and 8, the second mounting feature 340 has a diameter 341 extending along the fourth longitudinal axis 342. In the example embodiment of FIGS. 6 and 8, the third and fourth longitudinal axes are coplanar in the system X-Z plane. In this configuration, the second elliptical path traversed by the fourth longitudinal axis 334 is a circular path around the motor rotation axis 328. In other embodiments of the motor shaft 320 and or the motor rotor 324 usable with the present invention the fourth longitudinal axis 342 may be positioned to traverse an elliptical path around the motor rotation axis 328 with a major and a minor ellipse diameter. In any case, the diameter of the second elliptical path along the Y coordinate axis defines the stroke length of the gas displacing piston, which may be varied by changing the rotor or the shaft configuration.

In FIG. 6, the third and fourth longitudinal axes 334 and 342 are aligned with a system major axis Y or Z at each of the fourth step positions, 1-4. This configuration causes the movement of the gas compression piston and the gas displacing piston to be phase separated by 90° of motor rotation. FIG. 7 depicts an alternate embodiment of the motor shaft 320 usable to change the phase separation between the movement of the gas compression piston and the gas displacing piston. In particular, an alternative motor shaft 450 is configured with the second mounting feature 340 and its fourth longitudinal axis 342 angularly offset from an axis of the third longitudinal axis 334 by an angle 448. The second mounting feature may be angularly offset by the angle 448 to either advance or retard the phase of movement of the second mounting feature 340 with respect to the movement of the first mounting feature 336. Thus the motor shaft 450 is usable to advance or retard the initiation of the gas expansion step with respect to the gas compression step. Applicants have found that the cryocooler performance can be improved slightly by initiating the expansion step with an advanced or a retarded phase. In particular, by offsetting the fourth longitudinal axis 342 by angles 448 of up to about 15°, a phase angle between the end of the compression step and the initiation of the expansion step may occur at any phase angle in the rang of 75-115° of shaft rotation.

Thus according to one aspect of the present invention, the motor shaft 320 and the first and second drive couplings described above provide a Stirling cycle refrigeration device that can be configured with different phase relationships between the end of the compression step and the initiation of the expansion step by changing the configuration of the motor shaft 320 and specifically by configuring the second mounting feature 340 with an angular offset as shown in FIG. 7. According to another aspect of the present invention, a Stirling cycle refrigeration device can be configured with different a stroke length in the gas compression piston and the gas displacing piston by changing the configuration of the motor rotor 324, the motor shaft 320 or both to alter the position of the third and fourth longitudinal axes with respect to the motor rotation axis 328. Moreover, the present invention allows the stroke length in the gas compression piston to be changed independently from the stroke length in the gas displacing piston or visa versa.

Alternate Embodiment of the Second Drive Coupling

Figure 9:
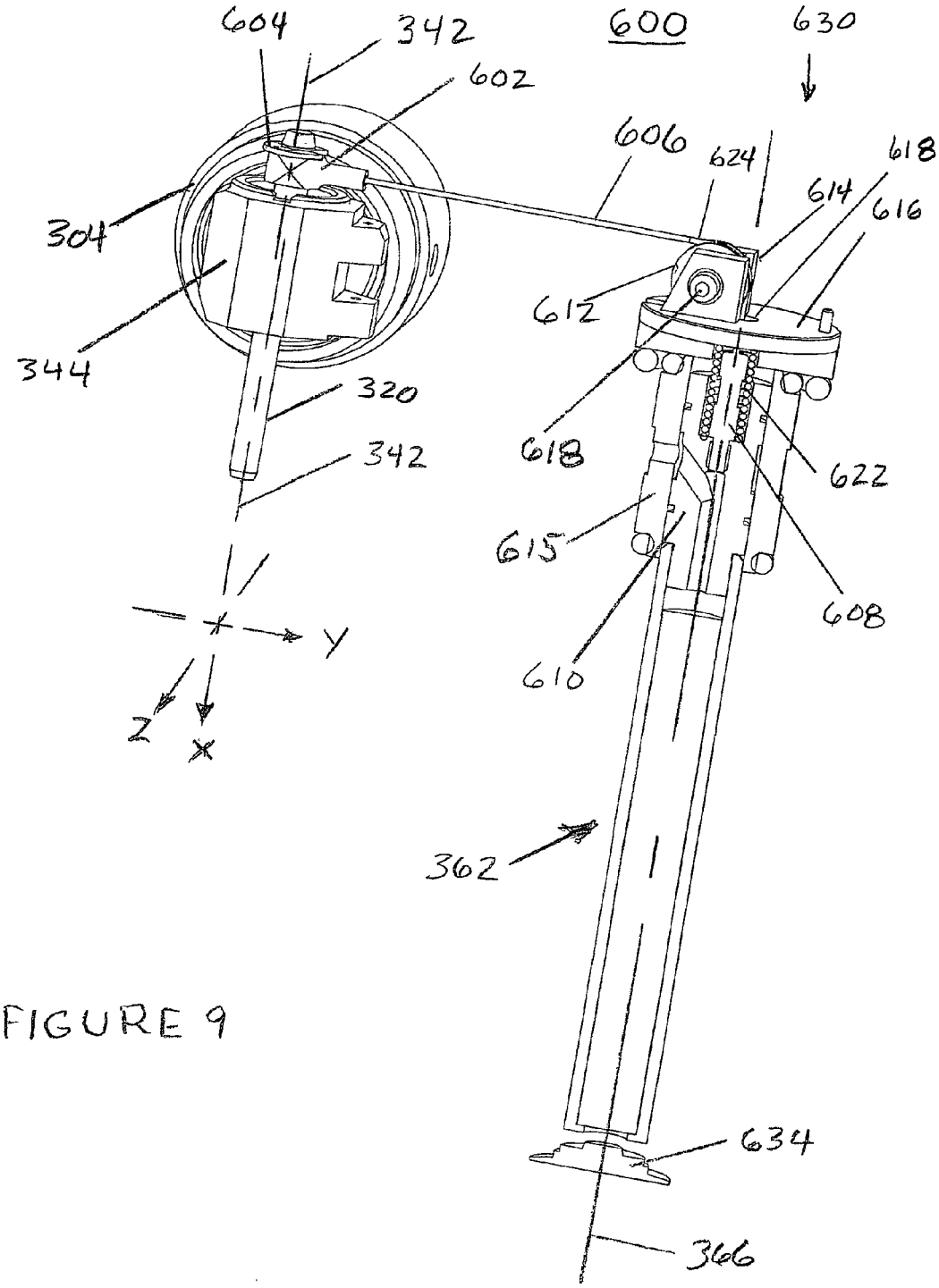
FIG. 9 illustrates an isometric internal view of an integrated cryocooler configured with a second drive coupling utilizing a flexible cable and compression spring according to the present invention.

An alternative embodiment of the present invention comprises a second drive coupling 600 configured as a cable drive, shown in isometric cutaway view in FIG. 9. The second drive coupling 600 attaches at an input end thereof to the motor shaft second attaching feature 340, which is centered by the fourth longitudinal axis 342. Thus the second drive coupling input end traverses the second elliptical path. The input end is formed as an input coupling 602 for rotatably attaching to the second mounting feature 340. The input coupling 602 may comprise an annular body with a bore formed therethrough for mating with the diameter 341 with a slight clearance fit to allow relative rotation of the mounting feature with respect to the coupling 602. The input coupling 602 may be captured between a shoulder 603, formed at a base of the second mounting feature diameter 341, and a clip ring 604 that is mechanically held within a groove 605 formed at the end of the second mounting feature diameter 341.

A tension element, e.g. a flexible cable 606, is fixedly attached to the input coupling 602, such as by a crimping element, and extends therefrom to a gas expansion unit, generally 630 for attaching to a gas displacing piston 362 supported within a gas expansion cylinder. Not all of the elements of the gas expansion unit 630 are shown in FIG. 9, however its construction and operation are substantially similar to the construction and operation of the gas expansion unit described above and shown in FIGS. 4 and 5.

The cable 606 extends from the input coupling 602 to an attaching element 608 at its output end. The attaching element is fixedly attached to a fluid control module 610 of gas displacing piston 632. The gas displacing unit 630 includes a cable base 616, at its warm end, and the cable base includes a clevis shaped support element 614 extending therefrom. The support element 614 supports a pulley 612 for rotation with respect thereto and the cable 606 wraps around the pulley 612 for guiding the cable 606 through a substantially 90° bend. The pulley 612 is a disk shaped element formed with a bore, not shown, through it center axis and with its circumferential edge being formed with a grooved or other guiding feature for supporting and or guiding the cable 606 over the pulley 612. In addition, the cable 606 may include a wear resistant sleeve 624 wrapped around the cable 606 in the region where the cable is in contact with the pulley 612.

The clevis shaped pulley support 614 includes opposing clevis elements that extend up from the support base 616 and capture the pulley 612 there between. A pin 618 extends through each of the clevis elements and through the bore through the center axis of the pulley 612 to provide a rotation axis for the pulley 612 such that the pulley rotates in response to longitudinal movement of the cable 606. The pin 618 is fixedly attached to one of the clevis elements, e.g. by a threaded engagement. Alternately, the pulley 612 may be non-rotatably supported with respect to the clevis support 614 such that the cable slides over the circumference of the pulley 612. The cable base element 616 is a disk shaped element the attaches to a first regenerator tube 615. The cable base 616 includes a center aperture 618 passing therethrough for providing access for the cable 606 to enter into the gas expansion cylinder.

The attaching element 608 is fixedly attached to the fluid control module 610 and to the cable 606. In addition, the attaching element 608 and the fluid control module 610 are formed to receive a compression spring 622 within an annular groove formed to surround the attaching element 608. The spring 622 provides a compression force that nominally biases the position of the gas displacing piston 632 downward toward the end cap 634. Thus the spring 622 forces the gas displacing piston to its top end position indicated as 85 in FIG. 2.

In operation, rotation of the motor rotor 324 causes the second mounting feature 340 and the input coupling 602 to traverse the second eccentric path around the motor rotation axis 328. As described above, movement along the second eccentric path generates reciprocating linear translations along each of the system Y and Z axes. The Y-axis motion varies tension on the cable 606 along its longitudinal axis. Any motion of the input coupling 602 along the Z-axis merely causes the cable to bend or flex about an axis approximately located at the interface between the cable 606 and the pulley 612.

As cable tension increases along its longitudinal axis, the cable pulls on the attaching element 608 and draws the gas displacing piston 362 along the second longitudinal axis (366), in the system negative X-direction until the gas displacing piston reaches its bottom end position (83 in FIG. 2). The cable tension force generated in the cable 606 must be sufficient to overcome the biasing force of the spring 622 in order to draw the gas displacing piston upward. As the cable tension is reduced, the spring bias force returns the gas displacing piston to the bottom end position 83. Accordingly, the cable 606 produces a variable tensioning force that increases during approximately half of each revolution of the motor rotor.

The cable actuator 600 provides a low cost alternative to the second drive coupling 360, described above, by reducing the number of parts and the complexity of driving the gas displacing piston. In addition the cable actuated drive 600 has fewer pinned connections and thereby operates with reduced mechanical play, and lower levels of audible noise. When using a cable actuated drive mechanism, a compression spring 622 may be selected with a high biasing force in order to ensure that during the entire range of motion of the gas displacing piston its motion is completely under the control of the forces applied by either the cable 606 or the compression spring 622. In this operating mode, the position of the gas displacing piston and its phase relationship with the gas expansion cylinder repeat during each refrigeration cycle, much like the operation of the system described above which uses mechanical linkages to tightly control the movement of gas displacing piston in accordance with a predefined pattern.

However, in an alternate embodiment of the cable actuator 600, according to a further aspect of the present invention, a compression spring 622 may be selected with a low biasing force. In this case, the low biasing force of the spring 622 may be able to be overcome by a pneumatic force generated by refrigeration fluid contained within the gas expansion space 380. In particular, as the pressure of the refrigeration gas contains within the gas expansion space exceeds a threshold level, a pneumatic force acting on the gas displacing piston exceeds the spring biasing force thereby advancing the gas displacing piston against the spring bias force toward its bottom end position 83. In this case the movement of the gas displacing piston may be influenced by the gas pressure inside the gas expansion space such that when the gas pressure exceeds a predetermined threshold, a pneumatic force overcomes the spring biasing force thereby pneumatically forcing the gas expansion space to expand. In this embodiment, the phase relationship between the gas compression step and the gas expansion step is directly correlated with the pressure of the refrigeration gas inside the gas expansion space to optimize system performance by allowing the expansion step to be self-tuning with occurrences of peak gas pressure inside the gas expansion space. Specifically the use of a low bias spring force allows the refrigeration cycle to become self tuning.

External View

Figure 10:
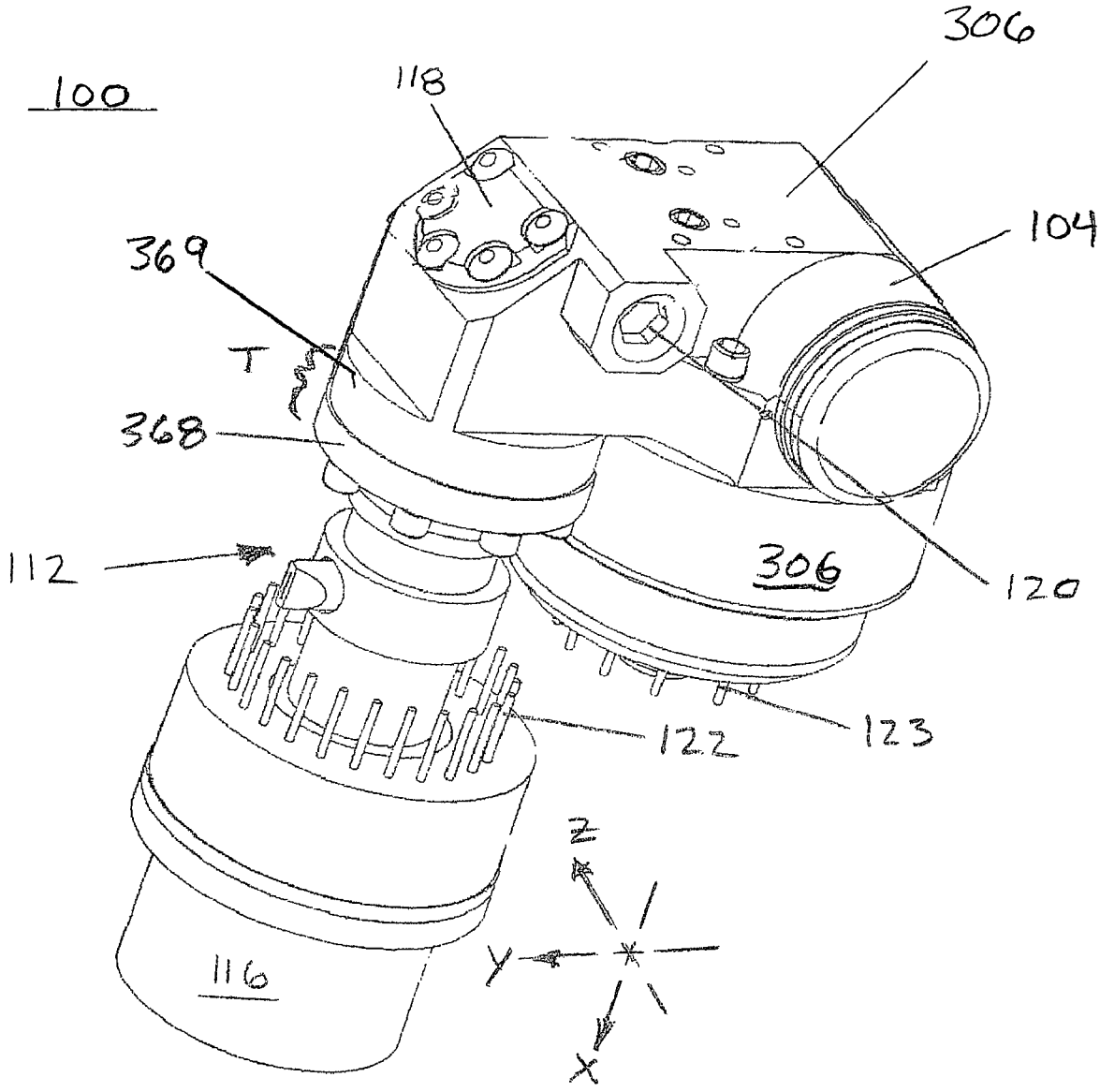
FIG. 10 illustrates an isometric external view of a sensor assembly according to the present invention.

FIG. 10 depicts an external isometric view of a miniature radiation sensor assembly 100 that includes the miniature cryocooler configured as described above according to the present invention. As shown, the sensor assembly 100 includes the DC motor 302 attached to the unitary crankcase 306. The gas compression unit 104 is configured as shown in FIG. 3 to compactly incorporate within the crankcase 306. The gas volume expansion unit, generally 112 attaches to the crankcase 306 by the mounting flanges 368 and 369 which include elements and features for forming the thermal barrier T approximately between the flanges. A Dewar assembly 116 is attached to the gas volume expansion unit 112, at its cold end, and encloses an infrared radiation sensor assembly, not shown, for cooling. The cold elements of the sensor assembly 100 are cantilevered away from the crankcase 306 to thermally isolate the cold elements from the warm elements. The motor shaft, the first drive coupling, the second drive coupling and the fluid passage that extends between the gas compression cylinder and the gas expansion cylinder are each housed inside the crankcase 306. Access to elements inside the crankcase 306 is provided through an access port and associated cover, collectively 118. In addition, the crankcase 306 includes a purge port and associated cover, collectively 120, for injecting a refrigeration gas into the crankcase 306.

The entire crankcase 306, gas compression unit 104, DC motor 302, and gas volume expansion unit 112 are filled with a refrigeration gas, preferably comprising helium. Accordingly, the crankcase 306 and each element attached thereto is configured with gas tight pressure seals defined by interfacing mating surfaces, labyrinths and gasket seals and as may be required. The sensor assembly 100 also includes electrical connecting pins 122 exiting from the Dewer assembly 116 for interfacing with a signal processor, not shown, and electrical connector pins 123 exiting from the DC motor 302 for interfacing with a motor driver, not shown. As further shown in FIG. 10, the system coordinate system is depicted to identify the three mutually perpendicular system coordinate axes X, Y and Z as defined above.

Figure 11A:
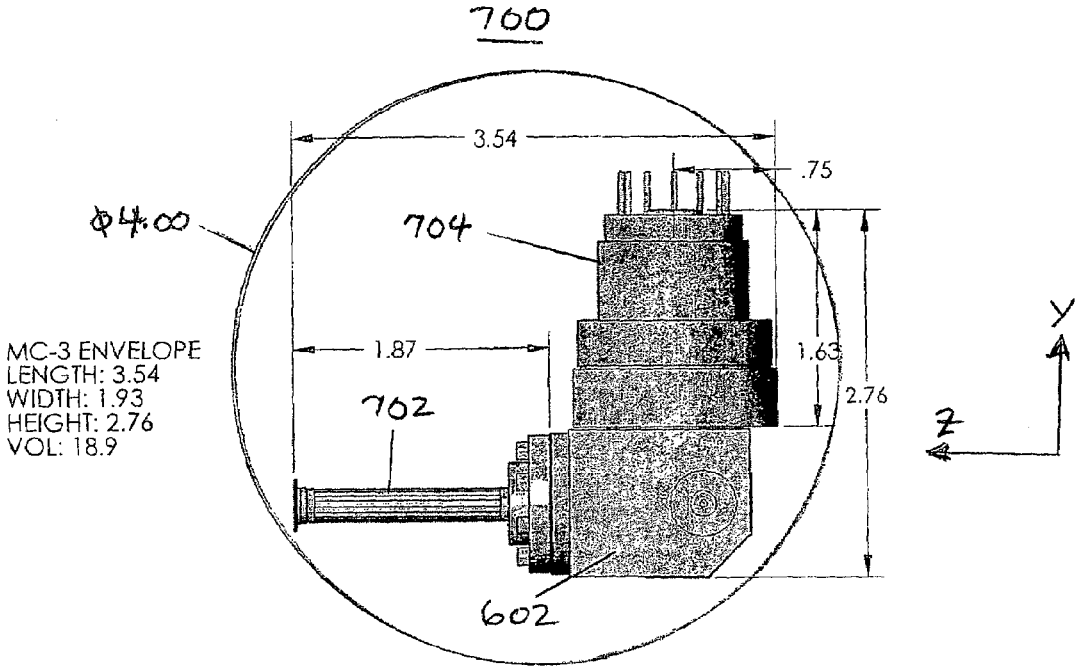
FIGURE 11A (PRIOR ART)
FIG. 11A illustrates a side view of a conventional cryocooler assembly.
Figure 11B:
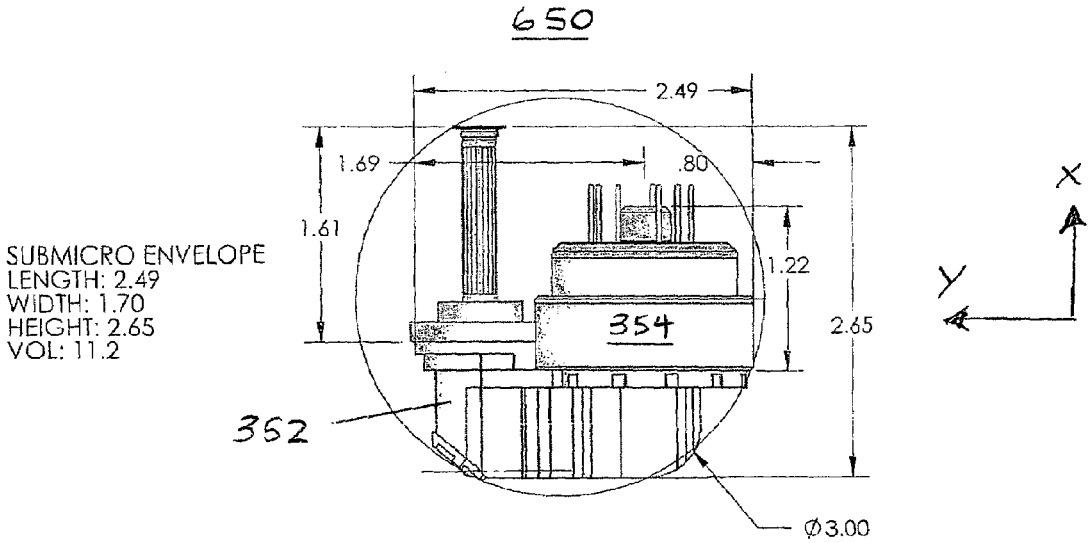
FIG. 11B illustrates a side view of a compact cryocooler assembly according to the present invention.

Generally a novel configuration of the sensor assembly 100 is folded to reduce its length by disposing the longitudinal axis of the gas volume expansion unit 112 to be substantially parallel with the rotation axis of the DC motor 302 with both axes extending parallel with the system X-axis. In addition, the longitudinal axis of the compression element 104 is disposed orthogonal to the DC motor rotation axis, along the system Z-axis and located partially housed within the crankcase 306 to further compact the device volume. By comparison, a convention cryocooler 700 is shown in FIG. 11A with its gas expansion unit 702 disposed orthogonal to the rotation axis of a DC motor 704. The cryocooler 700 has a circular envelope diameter of approximately 4.0 inches. By comparison, the folded cryocooler of the present invention is shown in FIG. 11B with a circular envelope diameter of approximately 3.0 inches.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. a miniature Stirling cycle cryocooler, those skilled in the art will recognize that its usefulness is not limited thereto and that the present invention can be beneficially utilized in any number of environments and implementations including but not limited to any refrigeration system. Accordingly, the claims set forth below should be construed in view of the full breadth and spirit of the invention as disclosed herein.

The invention claimed is:

1. An integrated radiation sensor assembly (10) comprising:

a gas compression unit (104) having a first longitudinal axis (308);

a gas expansion unit (112) having a second longitudinal axis (366) disposed perpendicular to the first longitudinal axis (308);

a rotary motor (302) comprising a rotor (324) supported for rotation with respect to a motor rotation axis (328) and disposed with the motor rotation axis (328) substantially parallel with the second longitudinal axis (366);

a motor shaft (320) extending from the rotor (324) and including a first mounting feature (336) extending along a third longitudinal axis (334), and a second mounting feature (340) extending along a fourth longitudinal axis (342), and wherein each of the third and fourth longitudinal axes (334, 342) are disposed substantially parallel with and radially offset from the motor rotation axis (328);

a first drive coupling means coupled between the first mounting feature (336) and the gas compression unit (104) for driving a gas compression piston (304) with a reciprocal linear translation directed along the first longitudinal axis (308);

a second drive coupling means coupled between the second mounting feature (340) and the gas expansion unit (112) for driving a gas displacing piston (362) with a reciprocal linear translation directed along said second longitudinal axis (366); and, a radiation sensor array (12) attached to a cold end of the gas expansion unit (112).

2. The integrated radiation sensor assembly of claim 1 wherein the radiation sensor array (12) is configured to produce an analog electrical signal responsive to infrared radiation, in a wavelength range of 3-5 microns, falling thereon.

3. The integrated radiation sensor assembly of claim 2 further comprising a Dewar assembly (16) attached to the gas expansion unit (112) at the cold end thereof and formed to enclose the radiation sensor array (12) within a sealed evacuated chamber 18.

4. The integrated radiation sensor assembly of claim 3 further comprising:

a digital signal processor (30) for receiving the analog electrical signal from the sensor array (12) and converting the analog electrical signal to a digital image signal; and, electrical pass through connections (28) connected to the sensor array (12) and passing though the Dewar assembly (16) to the digital signal processor (30) for communicating the analog electrical signal to the digital signal processor (30).

5. The integrated radiation sensor of claim 1 further comprising a unitary crankcase (306) formed with exterior walls surrounding hollow interior cavities and wherein the cavities are configured to house the first and second drive coupling means therein, the crankcase (306) being further configured to receive the gas compression unit (104) therein along the first longitudinal axis (308), to interface with the gas expansion unit (112) along the second longitudinal axis (366) and to receive a drive end of the rotary motor (304) therein with the motor rotation axis (328) disposed substantially parallel with the second longitudinal axis (366).

6. The integrated radiation sensor assembly of claim of claim 5 wherein the second drive coupling means comprises a plurality of interconnected mechanical linkages configured to apply a continuous drive force to the gas displacing piston (362).

7. The integrated radiation sensor assembly of claim 5 wherein said second drive coupling means comprises:

a tensioning element (606) configured to apply a variable tensioning drive force to the gas displacing piston (362); and, a compression spring configured to apply a biasing force opposed to the tensioning drive force.

8. The integrated radiation sensor assembly of claim 5 wherein the first drive coupling means comprises:

a rotary bearing means (344) coupled to the first mounting feature (336) for rotation with respect thereto; and, a bendable leaf spring (352) coupled between the rotary bearing means (344) and the gas compression piston (304).

9. The integrated radiation sensor assembly of claim 5 wherein the second drive coupling means comprises:

a first link (384) configured with an input coupling (386) rotatably coupled to the second mounting feature (340), an output coupling (388), and a flexure element (390) disposed between the input coupling (386) and the output coupling (388) and wherein the input coupling is driven by eccentric rotation of the second mounting feature (340) around the motor rotation axis (328) thereby generating a reciprocal translation of the output coupling (388);

a rocker element (392), pivotally attached to a rocker base (394) supported by the gas expansion unit (112), configured with a first arm (400), pivotally attached to the first link output coupling (388), and a second arm (402) extending orthogonally from the first arm (400) for generating an arcuate drive motion that includes a reciprocal translation coaxial with the second longitudinal axis (366); and, a third drive link (404) for reciprocally driving the gas displacing piston (362) along the second longitudinal axis (366) comprising an input coupling (406) coupled to the second arm (402), an output coupling (408) coupled to the gas displacing piston (362), and a flexure element (410) disposed between the input coupling (406) and the output coupling (408).

10. The integrated radiation sensor assembly of claim 5 wherein said second drive coupling means comprises:

a compression spring (622) disposed between a cable base (616), supported by the gas expansion unit (112), and the gas displacing piston (362) for exerting a compression force against the gas displacing piston (362) for biasing the gas displacing piston toward a stroke top end position (85); and, a tensioning element (606) extending between the second mounting feature (338) and the gas displacing piston (362) for exerting a variable tension force on the gas displacing piston (362), wherein the variable tension force periodically overcomes the compression force exerted by the compression spring to pull the gas displacing piston from the top end position (85) to a bottom end (83).

11. The integrated radiation sensor assembly of claim 1 wherein:

the first drive coupling means and the first mounting feature (336) are configured to advance the gas compression piston between a bottom end position (73) and a top end position (75) in response to the motor rotor (324) rotating through a first 180° of rotation;

the second drive coupling means and the second mounting feature (340) are configured to advance the gas displacing piston (362) between a bottom end position (83) and a top end position (85) in response to the motor rotor (324) rotating though a second 180° of rotation, and further wherein the second mounting feature (340) is configurable to cause occurrences of the gas displacing piston (365) bottom end position (83) to lag occurrences of the gas compression bottom end position by rotor rotation angles ranging from 75°-115°.

12. The integrated radiation sensor assembly of claim 1 wherein the gas expansion unit (112) includes a gas expansion space (380) at a cold end thereof and a warm end opposed the cold end further comprising:

a crankcase (306) for supporting the gas expansion unit (112) with the cold end extending out therefrom;

a thermal barrier (T) disposed between the gas expansion unit (112) and the crankcase (306) for thermally insulating the cold end from the warm end;

a first regenerator matrix (378) disposed inside the gas displacing piston (362) and extending substantially from the thermal barrier (T) to the gas expansion space (380); and, a second regenerator matrix (382) disposed inside the gas displacing piston (362) and substantially extending from the thermal barrier (T) to the warm end.

13. An integrated radiation sensor assembly (10) comprising:

a gas compression unit (104) disposed along a first longitudinal axis (308);

a gas expansion unit (112) disposed along a second longitudinal axis (366) disposed perpendicular to the first longitudinal axis (308);

a rotary motor (302) comprising a rotor (324) supported for rotation with respect to a motor rotation axis (328) and disposed with the motor rotation axis (328) substantially parallel with the second longitudinal axis (366);

a motor shaft (320) fixedly attached to the rotor (324) and extending longitudinally out from an end face of the rotor (324) for rotating with the rotor (324) wherein the motor shaft (320) includes a first mounting feature (336) disposed along a third longitudinal axis (334), which is substantially parallel with the motor rotation axis (324) and radially offset therefrom for rotating the first mounting feature (336) in a first eccentric path around the motor rotation axis (324), and a second mounting feature (340) disposed along a fourth longitudinal axis (342), which is substantially parallel with the motor rotation axis (324) and radially offset therefrom for rotating the second mounting feature (336) in a second eccentric path around the motor rotation axis (324);

a first drive coupling disposed between the first mounting feature (336) and the gas compression piston (304) for converting motion of the first mounting feature (336) in the first eccentric path around the motor rotation axis (328) to a reciprocating drive force for driving the gas compression piston (304) along the first longitudinal axis (308);

a second drive coupling disposed between the second mounting feature (340) and the gas displacing piston (362) for converting the motion of the second mounting feature (340) in the second eccentric path around the motor rotation axis (328) to a reciprocating drive force for driving the gas displacing piston (362) along said second longitudinal axis (366); and, a radiation sensor array (12) attached to a cold end of the gas expansion unit (112).

14. The integrated radiation sensor of claim 13 wherein said second drive coupling comprises:

a tensioning element (606) configured to apply a variable tensioning drive force to the gas displacing piston (362); and, a compression spring configured to apply a biasing force opposed to the tensioning drive force.

15. The integrated radiation sensor assembly of claim 13 wherein the second drive coupling comprises:

a compression spring (622) disposed between a cable base (616), supported by the gas expansion unit (112), and the gas displacing piston (362) for exerting a compression force against the gas displacing piston (362) for biasing the gas displacing piston toward a stroke top end position (85); and, a tensioning element (606) extending between the second mounting feature (338) and the gas displacing piston (362) for exerting a variable tension force on the gas displacing piston (362), wherein the variable tension force periodically overcomes the compression force exerted by the compression spring to pull the gas displacing piston from the top end position (85) to a bottom end (83).

16. The integrated radiation sensor of claim 15 wherein the gas displacing piston (362) is movable to vary the volume of a gas expansion space (380) and wherein the gas expansion space (380) receives refrigeration gas therein and further wherein the refrigeration gas within the gas expansion space exerts a pneumatic force on the gas displacing piston (362) with said pneumatic force directed substantially opposed to said compression force and further wherein the compression spring (622) is selected to generate a compression force that is less than the pneumatic force generated by peaks in refrigeration gas pressure amplitude inside the gas expansion space (380).

17. The integrated radiation sensor assembly of claim 13 wherein the second drive coupling comprises:

a first link (384) configured with an input coupling (386) rotatably coupled to the second mounting feature (340), an output coupling (388), and a flexure element (390) disposed between the input coupling (386) and the output coupling (388) and wherein movement of the input coupling along the second eccentric path generates a reciprocal translation of the output coupling (388);

a rocker element (392), pivotally attached to a rocker base (394) supported by the gas expansion unit (112), configured with a first arm (400), pivotally attached to the first link output coupling (388), and a second arm (402) extending orthogonally from the first arm (400) for generating an arcuate drive motion that includes a reciprocal translation coaxial with the second longitudinal axis (366); and, a third drive link (404) for reciprocally driving the gas displacing piston (362) along the second longitudinal axis (366) comprising an input coupling (406) coupled to the second arm (402), an output coupling (408) coupled to the gas displacing piston (362), and a flexure element (410) disposed between the input coupling (406) and the output coupling (408).

18. The integrated radiation sensor assembly of claim 13 wherein the gas expansion unit (112) includes a gas expansion space (380) at a cold end thereof and a warm end opposed to the cold end further comprising:

a crankcase (306) for supporting the gas expansion unit (112) the cold end extending out therefrom;

a thermal barrier (T) disposed between the gas expansion unit (112) and the crankcase (306) for thermally insulating the cold end from the warm end;

a first regenerator matrix (378) disposed inside the gas displacing piston (362) and extending substantially from the thermal barrier (T) to the gas expansion space (380); and, a second regenerator matrix (382) disposed inside the gas displacing piston (362) and substantially extending from the thermal barrier (T) to the warm end.

19. An integrated radiation sensor assembly comprising:

a gas compression unit (104) comprising a gas compression cylinder formed in the body of a crankcase (306) and a compression piston (304) supported for reciprocal movement within the compression cylinder wherein the reciprocal movement of the compression piston (304) is along a first longitudinal axis (308);

a gas expansion unit (112) comprising a gas expansion cylinder (364) extending out from the body of the crank case (306) and a gas displacing piston (362) supported for reciprocal movement within the gas expansion cylinder (364) wherein the reciprocal movement of the gas displacing piston (362) is along a second longitudinal axis (366) disposed perpendicular to the first longitudinal axis (308);

a rotary motor (302) comprising a rotor (324) supported for rotation with respect to a motor rotation axis (328) and disposed with the motor rotation axis (328) substantially parallel with the second longitudinal axis (366);

a motor shaft (320) fixedly attached to the rotor (324) and extending longitudinally out from an end face of the rotor (320) for rotating with the rotor (324) wherein the motor shaft (320) includes a first mounting feature (366) configured to move in a first eccentric path around the motor rotation axis (324) and a second mounting feature (336) configured to move in a second eccentric path around the motor rotation axis (324);

a first drive coupling disposed between the first mounting feature (366) and the gas compression piston (304) for driving the reciprocal movement of the compression piston (304) is along the first longitudinal axis (308);

a second drive coupling disposed between the second mounting feature (336) and the gas displacing piston (362) for driving the reciprocal movement of the gas displacing piston (362) is along the second longitudinal axis (366);

a radiation sensor array (12) attached to a cold end of the gas expansion unit (112); and, a Dewar assembly (116) attached to the gas expansion unit (112) at the cold end thereof and formed to enclose the radiation sensor array (12) within a sealed evacuated chamber 18.

20. The integrated radiation sensor assembly of claim 19 wherein the gas expansion unit (112) includes a gas expansion space (380) at a cold end thereof and a warm end opposed to the cold end further comprising:

a thermal barrier (T) disposed between the gas expansion unit (112) and the body of the crank case (306) for thermally insulating the cold end from the warm end;

a first regenerator module (378) disposed inside the gas displacing piston (362) and extending substantially from the thermal barrier (T) to cold end; and, a second regenerator module (382) disposed inside the gas displacing piston (362) and substantially extending from the thermal barrier (T) to the warm end.

21. The integrated radiation sensor assembly of claim 13 wherein the first drive coupling comprises:

a rotary bearing (344) coupled to the first mounting feature (336) for rotation with respect thereto; and, a bendable leaf spring (352) coupled between the rotary bearing (344) and the gas compression piston (304).

* * * * *